US005931136A

United States Patent [19]

Isobe et al.

[11] Patent Number: 5,931,136

[45] Date of Patent: Aug. 3, 1999

[54] THROTTLE CONTROL DEVICE AND CONTROL METHOD FOR INTERNAL COMBUSTION ENGINE

[75] Inventors: Daiji Isobe, Toyohashi; Shigenori Isomura, Kariya, both of Japan

[73] Assignee: Denso Corporation, Kariya, Japan

[21] Appl. No.: 08/989,006

[22] Filed: Dec. 11, 1997

[30] Foreign Application Priority Data

Jan. 27, 1997 [JP] Japan ..... 9-012140
Jan. 27, 1997 [JP] Japan ..... 9-012141

[51] Int. Cl.[6] ..... F02M 51/00

[52] U.S. Cl. ..... 123/399; 123/492

[58] Field of Search ..... 123/399, 488, 123/492–493

[56] References Cited

U.S. PATENT DOCUMENTS 4,552,116 11/1985 Kuroiwa et al. .
5,174,264 12/1992 Matsuoka et al. ..... 123/488
5,268,842 12/1993 Marston et al. ..... 123/488
5,642,708 7/1997 Heinrich et al. ..... 123/399
5,749,344 5/1998 Yoshiume et al. ..... 123/399
5,758,621 6/1998 Suzuki et al. ..... 123/399

FOREIGN PATENT DOCUMENTS 64-87845 3/1989 Japan .
3-185248 8/1991 Japan .
4-101031 4/1992 Japan .
4-134136 5/1992 Japan .
5-133257 5/1993 Japan .
5-222987 9/1993 Japan .
7-103028 4/1995 Japan .

*Primary Examiner*—Erick R. Solis
*Attorney, Agent, or Firm*—Nixon & Vanderhye P.C.

[57] ABSTRACT

Intake pressure is estimated for an engine load using an averaged accelerator depression position derived by smoothing sensed changes in accelerator depression position. Throttle valve opening angle is controlled based on the thus estimated intake pressure. A corresponding fuel injection value is calculated and supplied to the engine thus matching the estimated air and fuel amounts. Thus, deviation of the air-fuel mixture from a stoichiometric ratio can be reduced even with rapid and complicated accelerator operations.

10 Claims, 17 Drawing Sheets

THROTTLE CONTROL DEVICE AND CONTROL METHOD FOR INTERNAL COMBUSTION ENGINE

BACKGROUND OF THE INVENTION

1. Field of the Invention

The present invention relates to a throttle control device and a method for an internal combustion engine for controlling a throttle valve opening angle by driving a motor in accordance with accelerator depression.

2. Description of Related Art

A conventional throttle control for an internal combustion engine (electronic throttle system) throttle valve opening by driving a motor in accordance with accelerator depression amount or the like. For example, current is supplied to the motor in accordance with from an accelerator sensor signal detecting accelerator depression whereby the motor is driven to open or close the throttle valve and the amount of air supplied to an internal combustion engine is controlled. In this case, feedback control by proportional, integral and differential (PID) control is carried out to eliminate deviation between a throttle sensor signal detecting throttle opening angle and the accelerator sensor signal.

This device is disclosed in Examined Japanese Patent Publication No. 7-33781. In this device, a fuel amount based on accelerator depression or the like, is calculated and corresponding air amount for attaining a predetermined A/F (air-fuel ratio) is provided by controlling the throttle valve.

In this case, the fuel amount calculated from accelerator depression is estimated and calculated such that future operational condition is based on extension of the current operational condition. Meanwhile, when the accelerator is operated abruptly or in an otherwise complicated way, a discrepancy between the calculated fuel amount the requested fuel amount and A/F is varies significantly from the stoichiometric air-fuel ratio thereby deteriorating engine exhaust emission.

SUMMARY OF THE INVENTION

It is therefore an object of the present invention to provide device and a throttle control method for an internal combustion engine capable of maintaining the desired air-fuel ratio by appropriately corresponding air and fuel internal combustion engine even when the accelerator operation ungergoes an abrupt and/or complicated change.

According to the first aspect of the present invention, change in accelerator depression is smoothed and load of an internal combustion engine, for example, an intake pressure or an intake air amount, is estimated based on the smoothed accelerator depression amount. The amount of fuel supplied to the internal combustion engine is calculated based on the estimated load and the target throttle opening angle is controlled to constitute the estimated load. Therefore, when a complicated accelerator operation occurs, for example, when acceleration is carried out by depressing the accelerator a number of times, although the load change becomes complicated, the complicated accelerator depression changes are smoothed. Further, the fuel injection amount is calculated based on the estimated load based on the smoothed accelerator depression and a corresponding target throttle opening angle is calculated to estimate an actual load. Thereby, disturbance of A/F (air-fuel ratio) when complicated accelerator operation is carried out can be restrained.

Preferably, smoothing of the sensed accelerator depression is varied in accordance with the warm-up state of the internal combustion engine. Specifically, the lower the temperature of the internal combustion engine and the lower the volatility of heavy fuel or the like, the larger the degree of smoothing is made whereby abrupt acceleration is not carried out. More specifically, sensed accelerator depression is smoothed with a certain time constant and the lower the temperature of the internal combustion engine, the larger the time constant. In this case, as parameters representing the warm-up state of the internal combustion engine, cooling water temperature, oil temperature, elapsed time period after starting the internal combustion engine (number of ignitions, number of fuel injections, elapsed time or the like) may be used.

Preferably, accelerator depression changes are smoothed when the change is accelerator depression amount larger than a predetermined or in a predetermined time period when the change in accelerator depression is equal to or lower than the predetermined amount.

Preferably, a delay time caused in injecting fuel is calculated, the estimated load is corrected based on the calculated delay time and the target throttle opening angle is calculated based on the thus corrected estimated load. Thereby, the A/F (air-fuel ratio) can be more accurately controlled.

BRIEF DESCRIPTION OF THE DRAWINGS

Other objects, features and advantages of the present invention will be made more apparent by the following detailed description with reference to the accompanying drawings. In the accompanying drawings.

DETAILED DESCRIPTION OF THE PREFERRED EMBODIMENTS

An explanation will be given of embodiments of the present invention as follows.

(First Embodiment)

Figure 1:
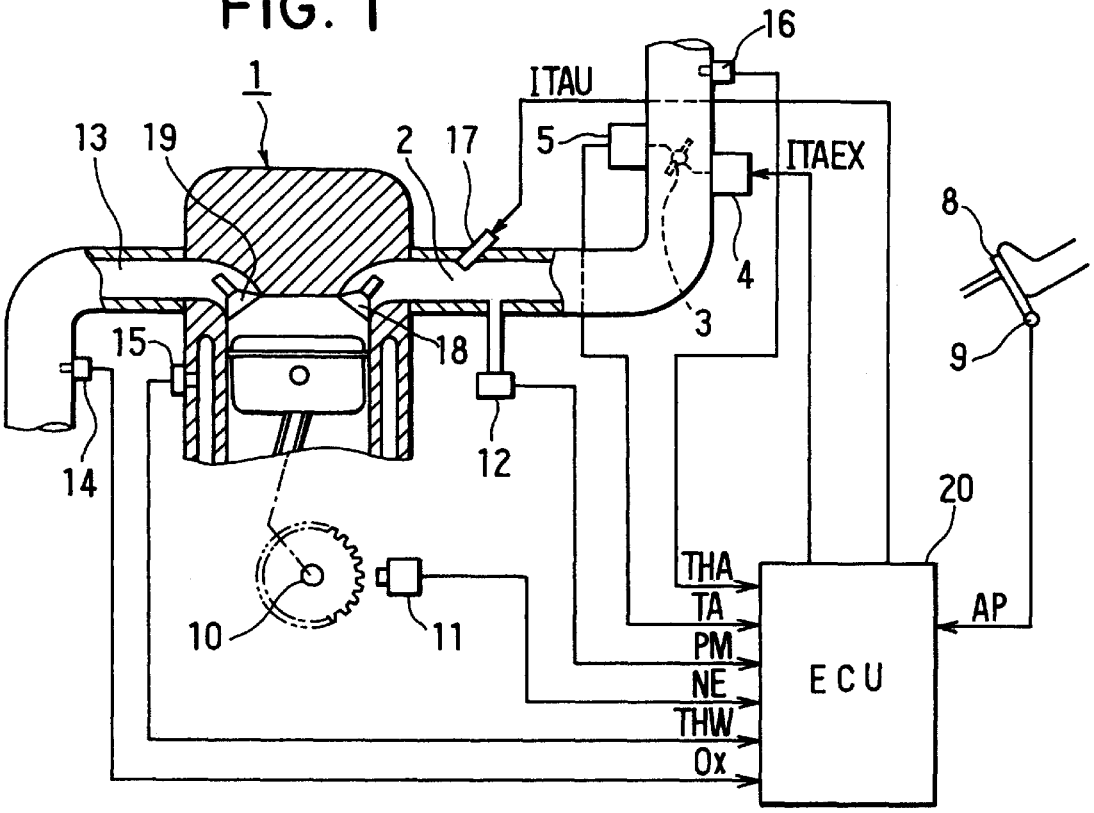
FIG. 1 is a schematic view showing a throttle control device according to the first embodiment of the present invention.

In FIG. 1, an internal combustion engine 1 is supplied with air-fuel mixture via an intake path 2. A throttle valve 3 is provided midway of the intake path 2 and is opened and closed by a DC motor (throttle valve driving means) 4 as an actuator whereby a flow rate of air passing through the throttle valve 3 is adjusted. A throttle opening angle sensor 5 for detecting a throttle opening angle is provided at the throttle valve 3. An accelerator depression position sensor 9 for detecting an accelerator depression amount is provided at an accelerator pedal 8. Further, a rotational angle sensor 11 for detecting a rotational speed of engine is arranged at a crankshaft 10 of the internal combustion engine 1. An intake pressure sensor 12 for detecting intake pressure in correspondence with an amount of air passing through the intake path 2 is installed to the intake path 2 of the internal combustion engine 1 and an oxygen concentration sensor 14 for detecting oxygen concentration in an exhaust path 13 is provided at the exhaust path 13 of the internal combustion engine 1. Further, a water temperature sensor 15 for detecting temperature of cooling water and an intake temperature sensor 16 for detecting temperature of intake air sucked into the intake path 2 on the upstream side of the throttle valve 3 in the intake path 2, are respectively installed. An injector (fuel injection valve) 17 is provided for supplying fuel into the intake path 2 of the internal combustion engine 1, an intake valve 18 is provided for opening and closing an intake port intaking air to the combustion chamber of the internal combustion engine 1 and an exhaust valve 19 is provided for opening and closing an exhaust port for exhausting gas from the combustion chamber of the internal combustion engine 1.

An ECU (Electronic Control Unit) 20 is connected to receive a throttle opening angle signal TA from the throttle opening angle sensor 5, an accelerator depression position signal AP from the accelerator depression position sensor 9, an engine rotational speed signal NE from the rotational angle sensor 11, an intake pressure signal PM from the intake pressure sensor 12, an oxygen concentration signal Ox from the oxygen concentration sensor 14, a cooling water temperature signal THW from the water temperature sensor 15 and an intake temperature signal THA from the intake temperature sensor 16.

Figure 2:
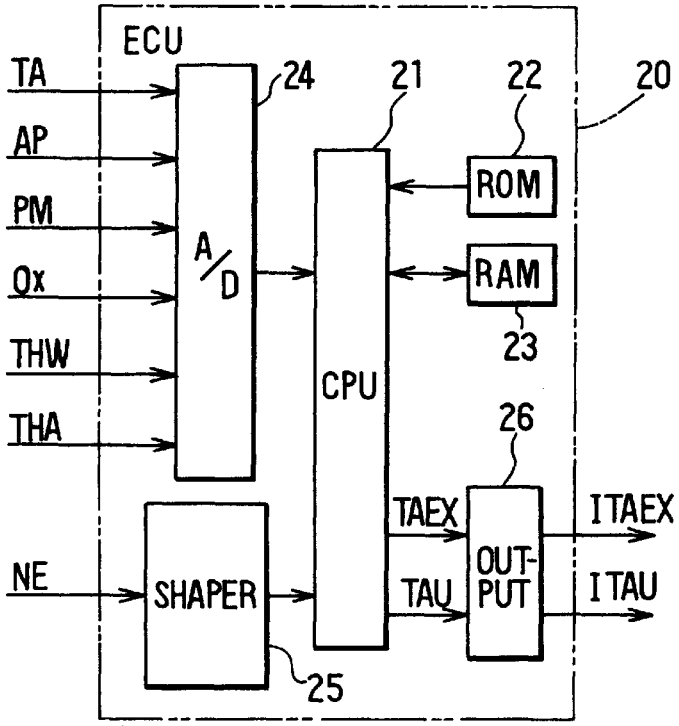
FIG. 2 is a block diagram showing an electric construction of ECU used in the first embodiment.

As shown in FIG. 2, the ECU 20 is constituted by a CPU (central processing unit) 21, ROM 22 storing control programs, RAM 23 storing various data, an A/D (Analog/Digital) converting circuit 24 for converting into digital signals respective analog signals of the throttle opening angle signal TA from the throttle opening angle sensor 5, the accelerator depression position signal AP from the accelerator depression position sensor 9, the intake pressure signal PM from the intake pressure sensor 12, the oxygen concentration signal Ox from the oxygen concentration sensor 14, the cooling water temperature signal THW from the water temperature sensor 15 and the intake temperature signal THA from the intake temperature sensor 16, a waveform shaping circuit 25 for shaping the waveform of the engine rotational speed signal NE from the rotational angle sensor 11, an output circuit 26 for supplying a current ITAEX for driving the DC motor 4 of the throttle valve 3 by a throttle valve target opening angle TAEX and a fuel injection time TAU and a current ITAU for driving the injector 17 calculated by CPU 21 based on the various information, and the like.

Figure 3:
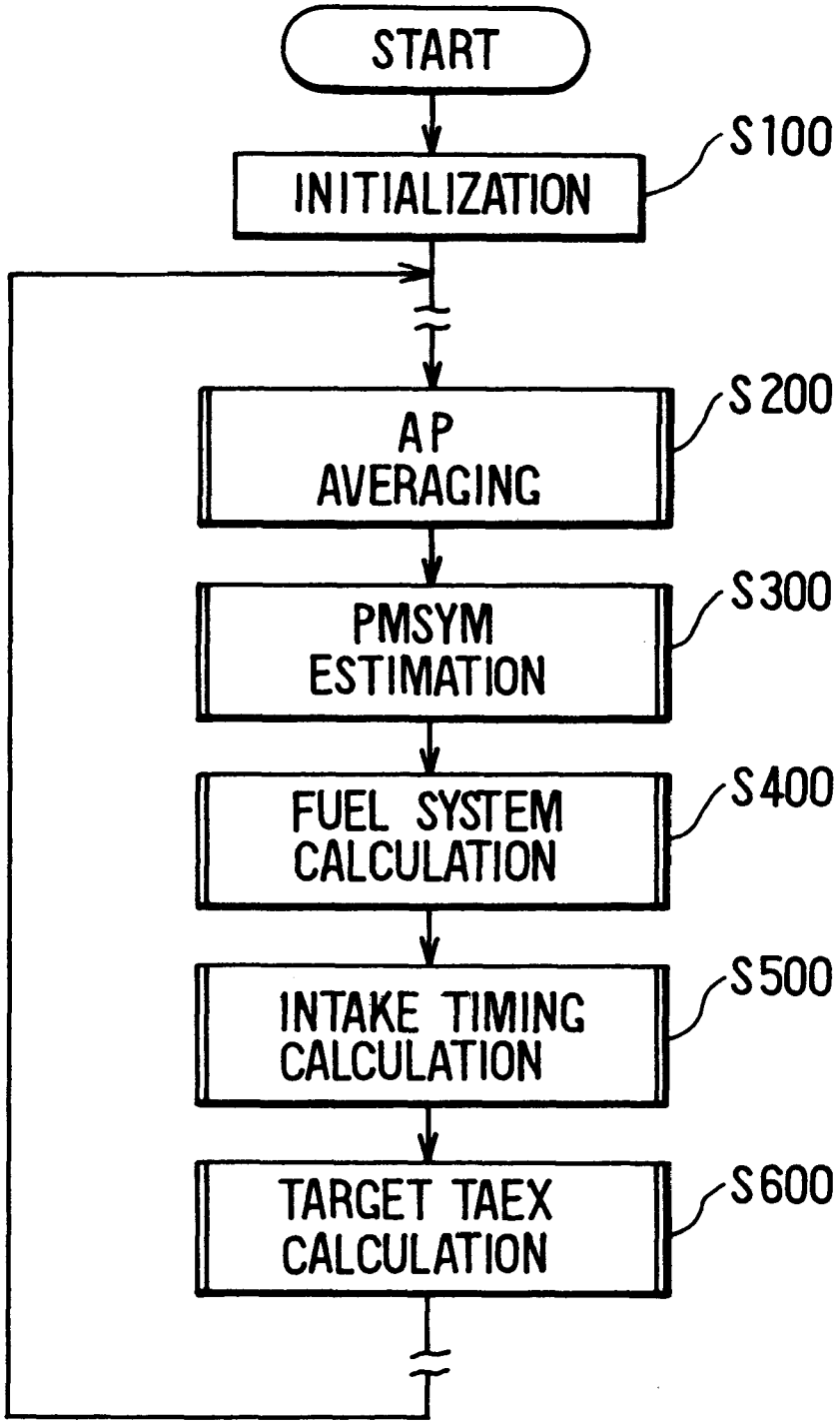
FIG. 3 is a flow chart showing a throttle control base routine of a CPU used in the ECU shown in FIG. 2.

In FIG. 3, firstly, initializing operation is executed at step S100 simultaneously with the supply of electric power by an ignition switch (not illustrated). According to the initializing operation, for example, variable storing regions at RAM 23 and the like are set to initial values and input signals from the various sensors are checked.

At step S200 after the initializing operation, the detected accelerator depression position AP is averaged by an accelerator depression position averaging or smoothing processing and an accelerator depression position AP' for simpliied calculation of a fuel injection amount is estimated. Next, the operation proceeds to step S300 and an estimated intake pressure PMSYM is calculated by an intake pressure estimating processing (load estimating processing) before operating the throttle valve 3 with the averaged accelerator depression position AP' and the engine rotational speed NE and the like as parameters. Next, the operation proceeds to step S400 and a fuel amount in compliance with the estimated intake pressure PMSYM and other parameters is calculated by a fuel system calculating processing. Next, the operation proceeds to step S500 and a timing of the intake pressure in agreement with the fuel amount for the stoichiometric air-fuel ratio ($\lambda$=1) is calculated by an intake pressure timing calculating processing. Next, the operation proceeds to step S600 and the throttle angle of the throttle valve 3 is reversely calculated based on the estimated intake pressure which has been processed to timing correction and an optimum throttle valve target opening angle TAEX is calculated by a throttle valve target opening angle calculating processing and thereafter, step S200 through step S600 are repeatedly executed.

Figure 4:
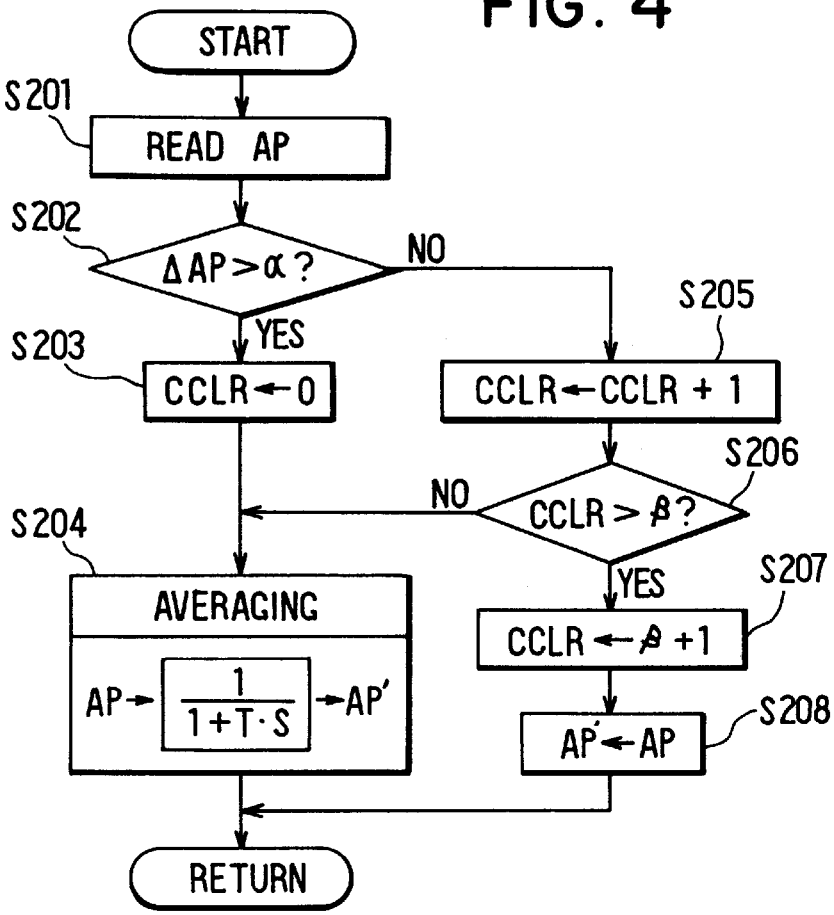
FIG. 4 is a flow chart showing an accelerator depression amount averaging process in FIG. 3.
Figure 5:
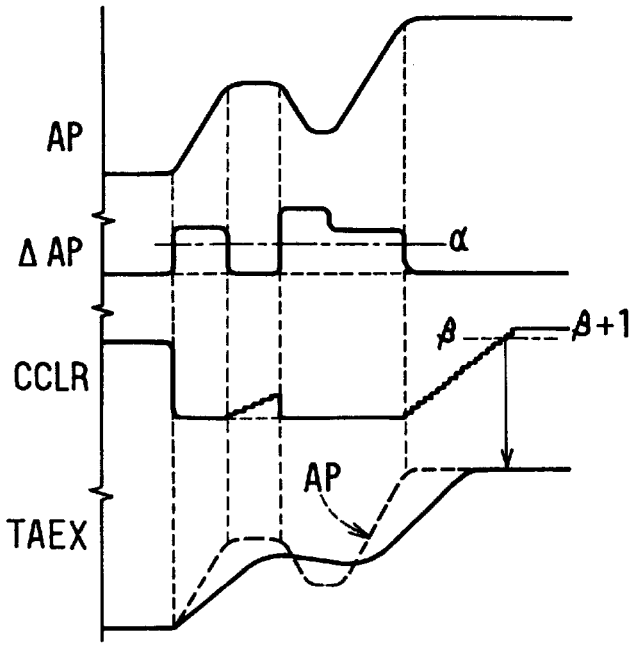
FIG. 5 is a time chart showing operation of the accelerator depression amount averating process in FIG. 4.
Figure 20:
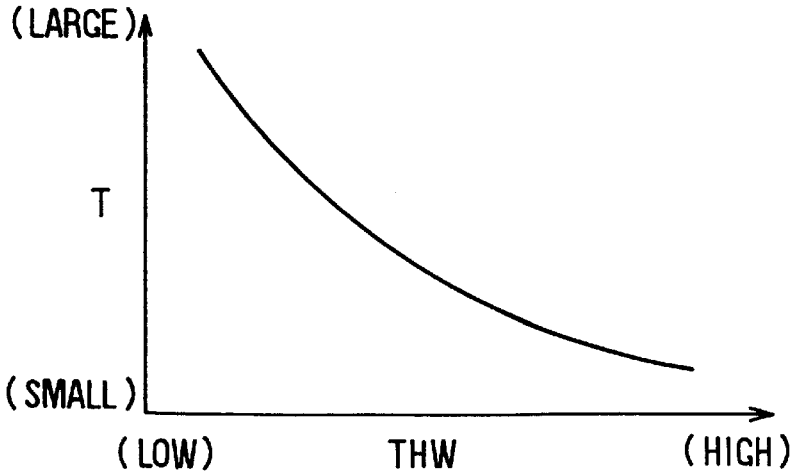
FIG. 20 is a data map for calculating a time constant from temperature of cooling water in the accelerator depression amount averaging process in FIG. 4.

In FIG. 4 showing the process of averaging the accelerator depression position at step S200 of FIG. 3, the accelerator depression position AP is read at step S201. Next, the operation proceeds to step S202 and whether an accelerator depression position change amount $\Delta$AP exceeds a predetermined value $\alpha$ is determined (FIG. 5). When the accelerator depression position change amount $\Delta$AP exceeds the predetermined value $\alpha$, the operation proceeds to step S203 and a steady state determining counter CCLR of the accelerator depression position AP is cleared to "0". Next, the operation proceeds to step S204 and an averaging processing in respect of the accelerator depression position AP is executed. A transfer function 1/(1+T·S) is used as a method of averaging and a time constant T thereof is set from a data map shown in FIG. 20 based on a warm-up state of the internal combustion engine 1. For example, when the engine warming up is finished, the time constant is set to T=248 (ms) and the processing of calculating the averaged accelerator depression position AP' in respect of the actually detected accelerator depression position AP is executed. Further, the warm-up state of the internal combustion engine 1 may be detected from cooling water temperature THW, oil temperature or the like, or may be calculated from an elapsed time period (number of ignitions, number of fuel injections, elapsed time period or the like) after starting the engine. In this case, the averaged accelerator depression position AP' calculated by averaging the accelerator depression position AP is stored in a store region of the averaged accelerator depression position AP' of RAM 23 in ECU 20.

By setting the time constant T in accordance with the warm-up state of the internal combustion engine 1, stall of the internal combustion engine 1 caused when the temperature of the internal combustion engine 1 is low can be prevented in the case where heavy fuel is used in a system for normal fuel. That is, the heavy fuel is poorer than the normal fuel in respect of the volatility and therefore, A/F (air-fuel ratio) becomes lean when the temperature of the internal combustion engine 1 is low and the tendency is intensified when abrupt acceleration is performed. Hence, when the temperature of the internal combustion engine 1 is low, in averaging the accelerator depression position, abrupt acceleration is restrained by enlarging the time constant T and the internal combustion engine 1 is prevented from stalling even if the heavy fuel is used.

Meanwhile, when the accelerator depression position change amount $\Delta$AP is equal to or lower than the predetermined value a at step S202, it can be determined that in operating the accelerator, the control of the throttle opening angle, fuel injection or the like is not so difficult that the accelerator depression position AP needs to be averaged and accordingly, the operation proceeds to step S205 and the steady state determining counter CCLR is incremented by "1". Next, the operation proceeds to step S206 and whether the steady state determining counter CCLR exceeds a predetermined value $\beta$ (FIG. 5). When the steady state determining counter CCLR exceeds the predetermined value $\beta$, it is determined that the accelerator depression position AP is in a stable state and the operation proceeds to step S207 and an overflow processing where the steady state determining counter CCLR is changed by adding "1" to the predetermined value $\beta$ and thereafter, the operation proceeds to step S208 and an unaveraged accelerator depression position AP is stored as it is to the store region of the averaged accelerator depression position AP' of RAM 23 in ECU 20. Further, when the steady state determining counter CCLR is equal to or lower than the predetermined value $\beta$, the operation proceeds to step S204 and the averaging processing in respect of the above-described accelerator depression position AP is executed.

Figure 6:
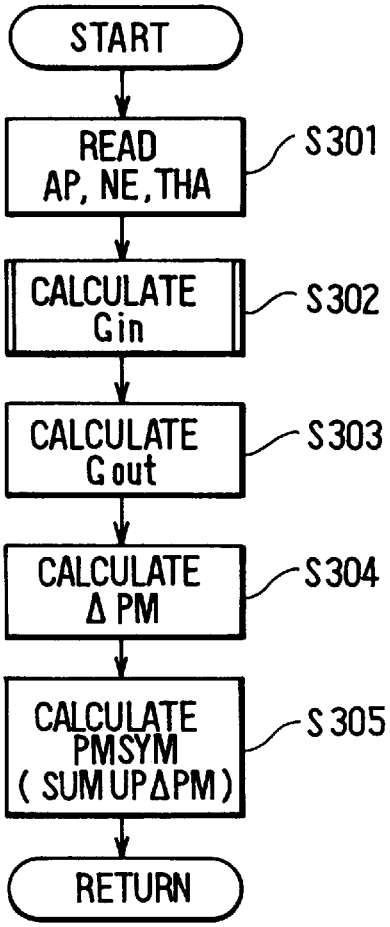
FIG. 6 is a flow chart showing an intake pressure estimating process in FIG. 3.

Following the process of FIG. 4, the intake pressure estimation of step S300 in FIG. 3 is performed as shown in FIG. 6. In this case, the estimated intake pressure is an intake pressure in respect of the smoothed accelerator depression position, that is, an intake pressure when the throttle valve 3 is controlled based on the smoothed accelerator depression position.

Figure 7:
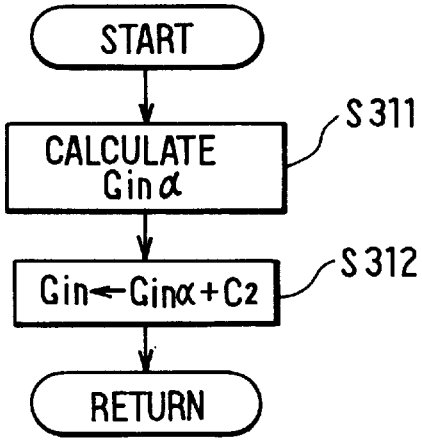
FIG. 7 is a flow chart showing an air amount calculating process in FIG. 6.

In FIG. 6, firstly, in step S301, parameters of accelerator depression position AP' formed by averaging the accelerator depression position AP, the engine rotational speed NE, the intake temperature THA and the like are read. Next, the operation proceeds to step S302 and a processing of calculating air amount Gin passing through a surge tank (not shown) is executed. According to the processing of calculating the air amount Gin passing through the surge tank, an air amount Gin$\alpha$ (kg/sec) passing through the throttle valve 3 is firstly calculated by the following equation (1) at step S311 in the subroutine of FIG. 7.

$$\text{When } PM \le \left(\frac{2}{\kappa+1}\right)^{\frac{1}{\kappa-1}} PA \tag{1}$$

$$Gin\alpha = CC\sqrt{\frac{2\kappa}{\kappa+1}\left(\frac{2}{\kappa+1}\right)^{\frac{2}{\kappa-1}}}$$

$$\text{when } PM > \left(\frac{2}{\kappa+1}\right)^{\frac{1}{\kappa-1}} PA, \text{ with } CC = \frac{PA}{(R\cdot T)^{\frac{1}{2}}}\cdot S$$

$$Gin\alpha = CC\sqrt{\frac{2\kappa}{\kappa-1}\left\{\left(\frac{PM}{PA}\right)^{\frac{2}{\kappa}} - \left(\frac{PM}{PA}\right)^{\frac{\kappa+1}{\kappa}}\right\}}$$

where PA: atmospheric pressure [Pa], S: flow sectional area [$m^2$], $\kappa$: ratio of specific heat, R: gas constant [J/(kg·K)] and T: intake temperature [K].

Next, the operation proceeds to step S312, the air amount Gin [kg/sec] passing through the surge tank is calculated by adding a leakage air amount C2 [kg/sec] to the air amount Gin$\alpha$ passing through the throttle valve and thereafter, the operation returns to the subroutine of FIG. 6 and at step S303, an amount of air Gout [kg/sec] flowing into the cylinder is calculated by the following equation (2).

$$Gout = C3\cdot PM\cdot NE\left\{1 - \frac{1}{\varepsilon}\left(\frac{PE}{PM}\right)^{\frac{1}{\kappa}}\right\} \tag{2}$$

where NE: engine rotational speed [rpm], PE: exhaust pressure=atmospheric pressure [Pa, $N/m^2$], $\epsilon$: compression ratio, $\kappa$: ratio of specific heat, C3:Vc/(2×60×R×T) and Vc: total exhaust amount [$m^3$].

Next, the operation proceeds to step S304 and a change in the intake pressure ΔPM (differential value of intake pressure PM) is calculated by the following equation (3).

$$\Delta PM = dPM/dt = \{(Gin - Gout)/V\}\kappa RT \quad (3)$$

where PM: intake pressure [Pa, $N/m^2$], t: time [sec], Gin: air amount passing through a surge tank [kg/sec], Gout: air amount flowing into the cylinder [kg/sec], V: volume of the surge tank [$m^3$]κ: ratio of specific heat, R: gas constant [J/(kg·K), Nm/(kg·K)] and T: intake temperature [K].

Next, the operation proceeds to step S305 and the change in intake pressure ΔPM is summed up (at every very small time Δt) whereby the estimated intake pressure PMSYM (FIG. 19A) is calculated.

Figure 8:
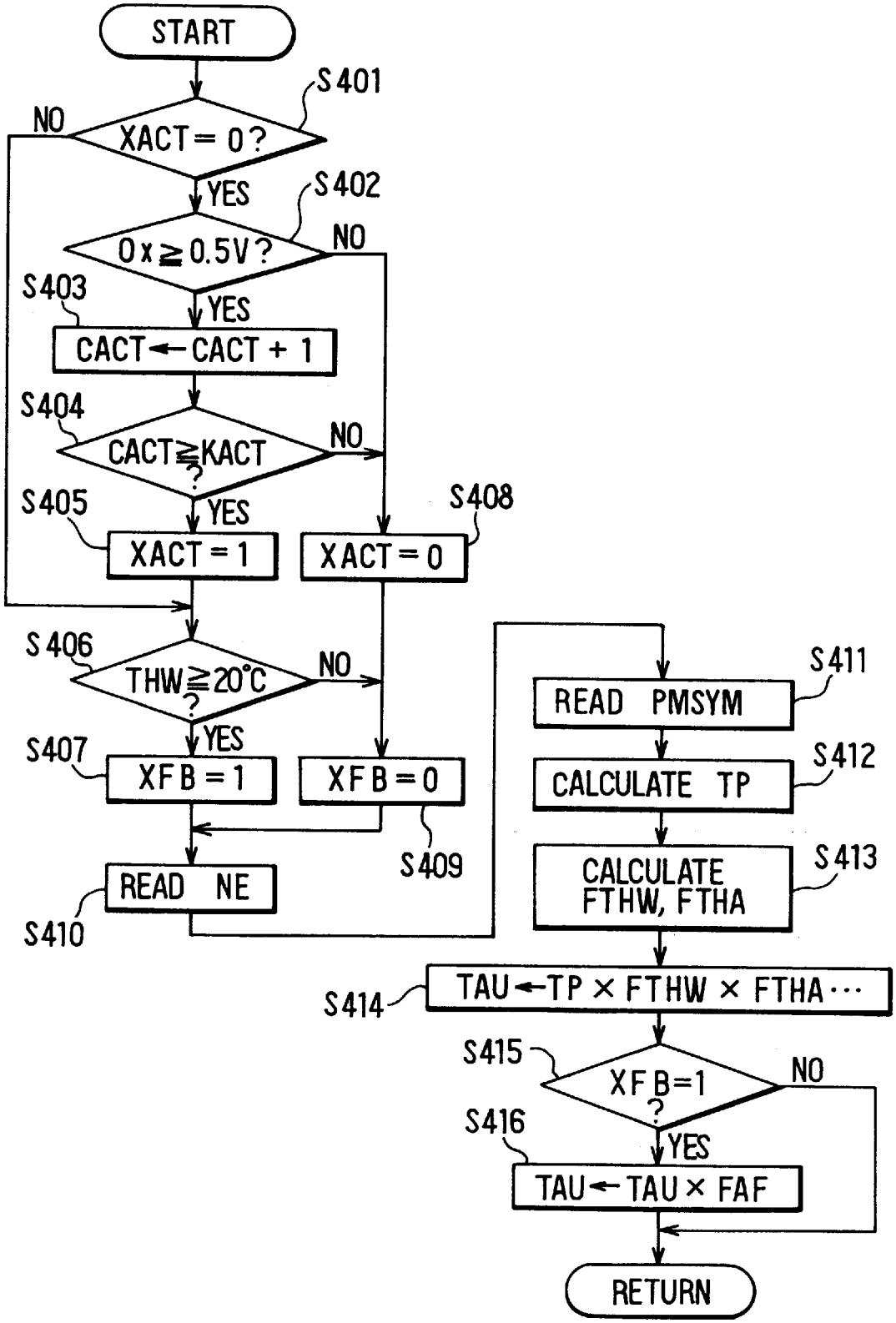
FIG. 8 is a flow chart showing a fuel amount calculating process in FIG. 3.

The fuel system calculating processing at step S400 in FIG. 3 is performed as shown in FIG. 8 in which a fuel injection time TAU that is needed in the A/F (air-fuel ratio) control is calculated in reference to the output voltage of the oxygen concentration sensor 14.

In the A/F control, the basic fuel injection time TAU is calculated based on the engine rotational speed NE and the intake pressure PM and a correction based on water temperature, atmospheric temperature and the like influencing on the combustion state and a feedback control based on the oxygen concentration in the exhaust path 13 after combustion are executed. The feedback control is executed to correct a deviation caused by the individual difference, aging change or the like of the internal combustion engine 1. According to the embodiment, firstly, it is determined whether the feedback control by the oxygen concentration sensor 14 in the exhaust path 13 is possible. That is, the oxygen concentration sensor 14 is activated only at an elevated temperature or higher and therefore, immediately after starting the internal combustion engine 1, the oxygen concentration signal ox of the oxygen concentration sensor 14 cannot be used in the A/F control. An activation flag XACT for representing whether the oxygen concentration sensor 14 is activated is used, the activation flag XACT is set to "0" by initialization and set to "1" at a time point of activation.

Figure 9:
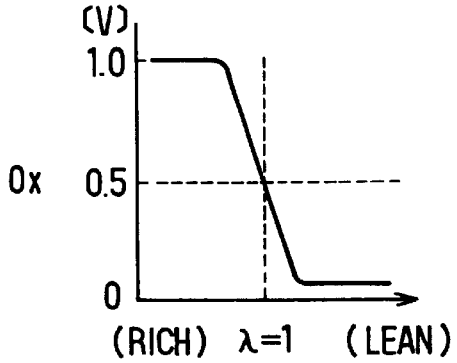
FIG. 9 is a characteristic graph showing an output voltage in respect of an air-fuel ratio of an oxygen concentration sensor used in the first embodiment.

In FIG. 8, firstly, at step S401, whether the activation flag XACT of the oxygen concentration sensor 14 arranged in the exhaust path 13 is set to "0" is determined. When the oxygen concentration sensor 14 has not been activated yet, the operation proceeds to step S402 and whether the oxygen concentration signal Ox from the oxygen concentration sensor 14 is equal to or higher than 0.5 V (stoichiometric air-fuel ratio: λ=1) is determined. Here, substantially 0 V is outputted as the oxygen concentration signal Ox from the oxygen concentration sensor 14 until the sensor is activated. After the sensor is activated, as shown by FIG. 9, substantially 1.0 V is outputted in the case where an air excess rate λ is determined to be less than the predetermined reference value (determination of rich state [less than λ=1]) and substantially 0 V is outputted in the case where λ is determined to be equal to or higher than the predetermined reference value (determination of lean state [higher than λ=1]). Accordingly, when the engine is started at a low temperature, the engine is controlled with A/F (air-fuel ratio) in a rich state and therefore, the determination of activation of the oxygen concentration sensor 14 is carried out by whether the oxygen concentration signal Ox is equal to or higher than 0.5 V that is a criteria of activation.

Following step S402, the operation proceeds to step S403 and an activation counter CACT for measuring stabilized time period is incremented by "+1" since even if the oxygen concentration signal Ox is equal to or higher than 0.5 V, the signal may not be stabilized. Next, the operation proceeds to step S404 and whether the activation counter CACT is equal to or higher than a set value KACT in correspondence with the stabilized time period is determined. When the criteria of step S404 is established, the oxygen concentration sensor 14 is determined to have been activated, the operation proceeds to step S405 and the activation flag XACT is set to "1". When the oxygen concentration sensor 14 is determined already activated at step S401, the activation flag XACT has the value of 1 and step S402 through step S405 are skipped.

Here, even if the oxygen concentration sensor 14 has been activated, the feedback control cannot be performed only by the activation of the oxygen concentration sensor 14. As other condition of executing the feedback control, whether the cooling water temperature THW detected by the water temperature sensor 15 arranged in the internal combustion engine 1 is equal to or higher than 20° C. is determined at step S406. When the criteria of step S406 is established, the operation proceeds to step S407 and a feedback allowance flag XFB is set to "1". Meanwhile, when the criteria of step S402 is not established or when the criteria of step S404 is not established, the activation flag XACT is set to "0" at step S408 for confirmation. After step S408 or when the criteria of step S406 is not established, the operation proceeds to step S409 and the feedback allowance flag XFB is set to "0".

Figure 10:
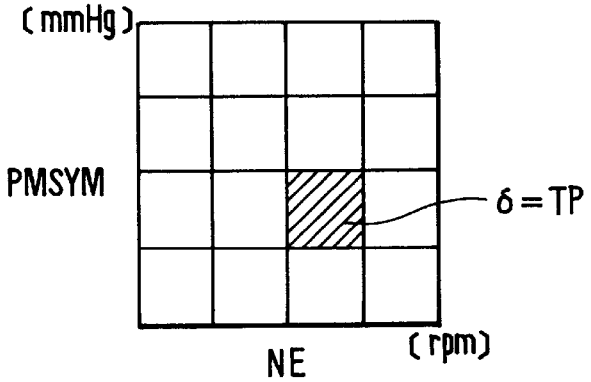
FIG. 10 is a data map for calculating a basic fuel injection time in FIG. 8.

After setting the feedback allowance flag XFB at step S407 or step S409, the engine rotational speed NE is read at step S410 and the estimated intake pressure PMSYM calculated from the averaged accelerator depression position AP' is read at step S411. Next, the operation proceeds to step S412 and a basic fuel injection time TP calculated such that λ=1 previously by experiment with the engine rotational speed NE and the estimated intake pressure PMSYM as parameters by the data map shown by FIG. 10. Next, the operation proceeds to step S413 and a cooling water temperature correction coefficient FTHW is calculated based on the cooling water temperature THW, an intake temperature correction coefficient FTHA is calculated based on the intake temperature THA and so on. Next, the operation proceeds to step S414 and the fuel injection time TAU is calculated by multiplying the basic fuel injection time TP by the cooling water temperature correction coefficient FTHW, the intake temperature correction coefficient FTHA and the like. Further, although optimum values provided by experiment are used in the correction coefficients, the values may be calculated by using a data map or a predetermined calculation equation. Next, the operation proceeds to step S415 and whether the feedback allowance flag XFB has the value of "1" is determined. When the condition of executing the feedback control is established, the criteria of step S415 is established and the operation proceeds to step S416. In step S416, the fuel injection time TAU calculated at step S414 is multiplied by a feedback correction value (air-fuel ratio correction coefficient) FAF.

Figure 11:
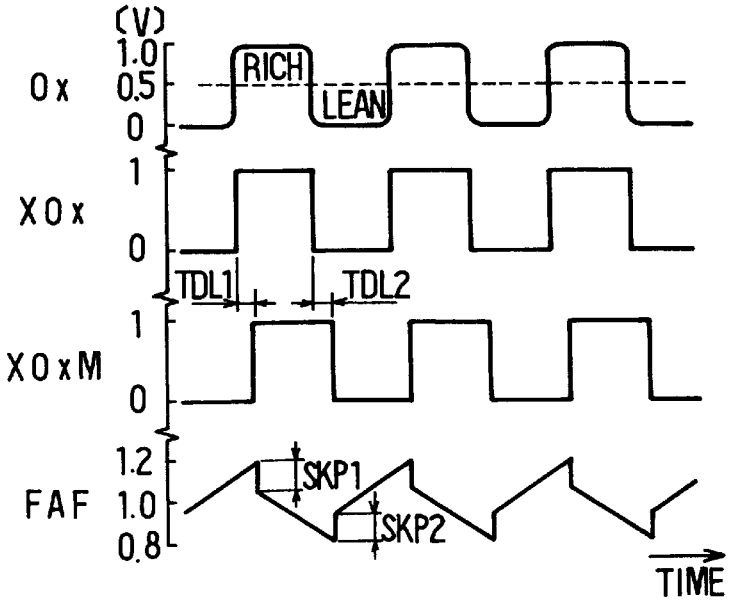
FIG. 11 is a time chart showing a feedback correction value calculating process in FIG. 8.

Here, the feedback correction value FAF is calculated as shown in FIG. 11. That is, a control where the fuel injection time TAU is increased when A/F (air-fuel ratio) is lean, the fuel injection amount starts decreasing when A/F is reverted from the lean side to the rich side and the fuel injection amount starts increasing when A/F is again reverted from the rich side to the lean side, is repeated with reference to the oxygen concentration signal ox in the exhause path 13.

Specifically, to form the feedback correction value FAF having a value of 1.0 as the base point, a flag XOx is formed based on whether the oxygen concentration signal Ox from the oxygen concentration sensor 14 is on the rich side of 0.5 V and a flag XOxM is operated to form such that a delay value TDL1 is provided on the rise side of the revert point of the flag XOx and a delay value TDL2 is provided on the fall side thereof. Based on the delayed flag XOxM, a predetermined integral value INT1 for the integral control is added on the lean side for increasing the feedback correction value FAF and a predetermined integral value INT2 for the integral control is added on the rich side to decrease the feedback correction value FAF. Further, in order to promote the response and to prevent fluctuation of A/F (air-fuel ratio), when the flag XOxM is reverted to the rise side, the feedback correction value FAF is added with a skip value SKP1 for the proportional control and is skipped to the decreasing side and conversely, when the flag XOxM is reverted to the fall side, the feedback correction value FAF is added with a skip value SKP2 for the proportional control and is skipped to the increasing side.

The delay values TDL1 and TDL2, integral values INT1 and INT2 and skip values SKP1 and SKP2 are pertinent values respectively calculated easily by experiment such that the above factors of deviation caused by the individual engine difference, the aging change or the like can be resolved. Meanwhile, when the feedback control is not allowed at step S405 shown in FIG. 8, the fuel injection time TAU calculated at step S414 is used as it is as the final fuel injection time TAU. Using the fuel injection time TAU not multiplied with the feedback correction value FAF in this way, signifies execution of an open loop control.

An injection start timing and an injection finish timing are set to the injector 17 and during the period, the fuel injection is attained by the injector 17. Further, in the fuel injection, the injection finish timing must be previously determined in correspondence with the combustion cycle of the internal combustion engine 1 and the injection start timing is set from the injection finish timing.

Figure 12:
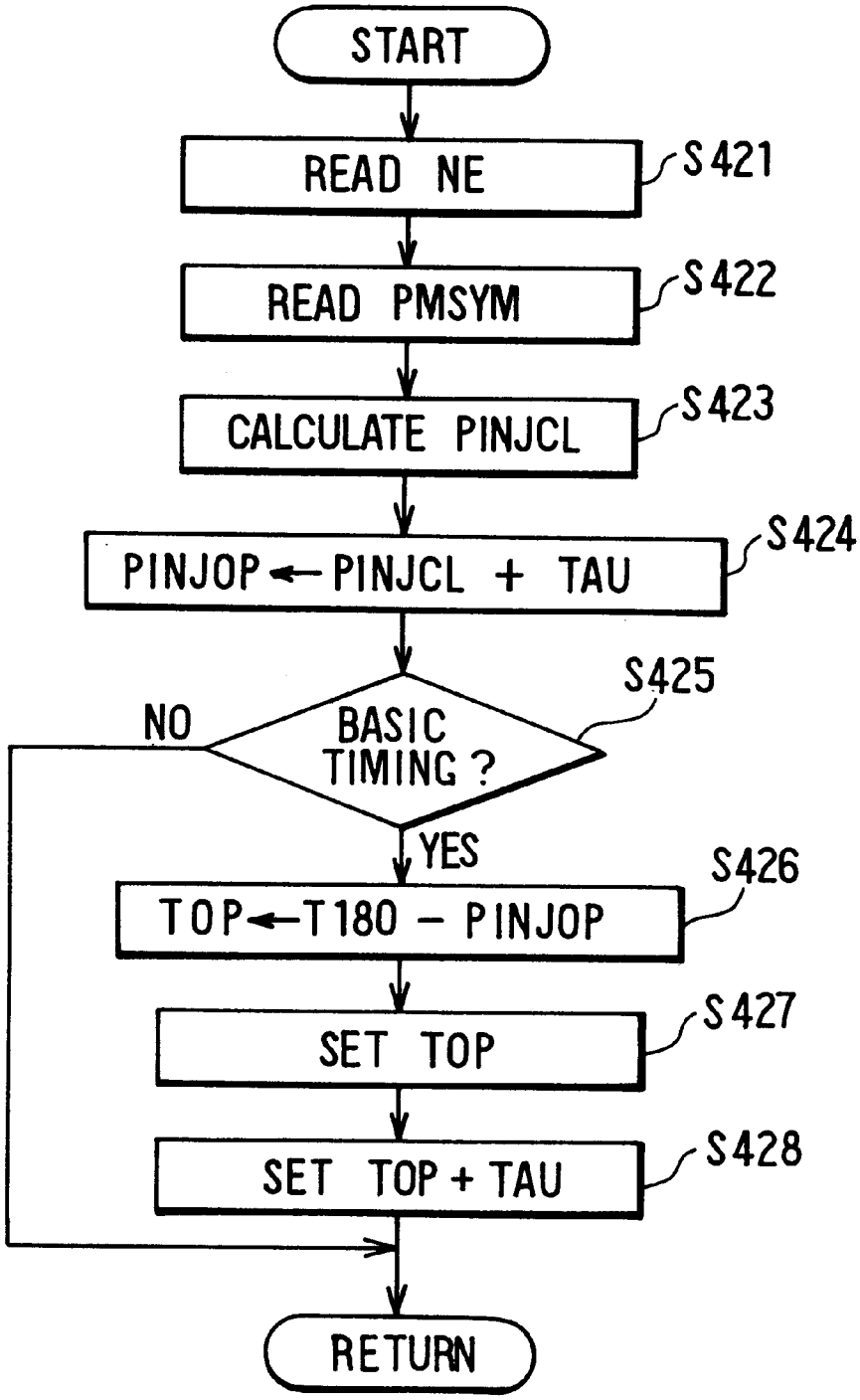
FIG. 12 is a flow chart showing an injector drive control process in the first embodiment.
Figure 13:
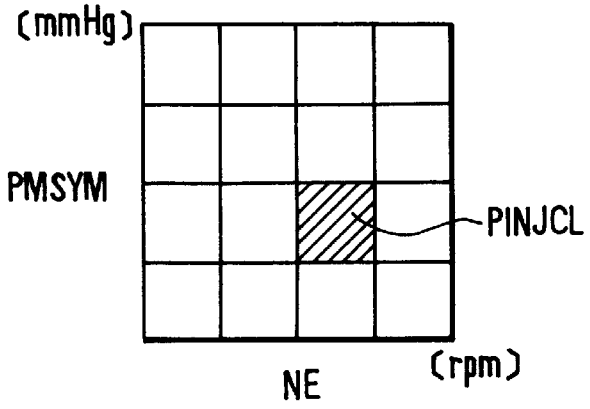
FIG. 13 is a data map for calculating valve closing time of the injector in FIG. 12.
Figure 14:
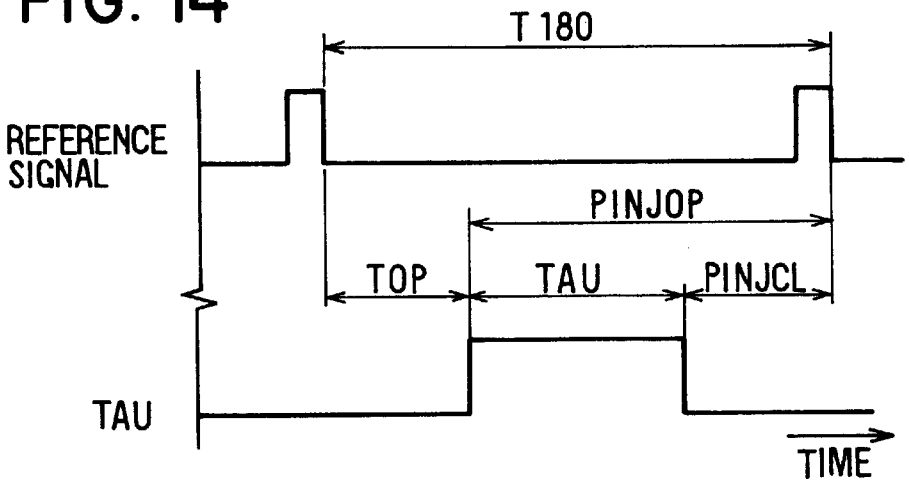
FIG. 14 is a time chart showing a signal of driving the injector in respect of a reference signal for each cylinder according to the first embodiment.

In FIG. 12, at step S421, the engine rotational speed NE is read, the estimated intake pressure PMSYM is read at step S422 and thereafter, the operation proceeds to step S423 and a valve closing time PINJCL of the injector 17 is calculated by using a data map of FIG. 13. Next, the operation proceeds to step S424 and a valve opening time PINJOP is calculated by adding the fuel injection time TAU to the valve closing time PINJCL. As shown in FIG. 14, by using T180 representing by time, 180° CA (crank angle) which is a signal interval of reference signal T180 for each cylinder and a valve opening timing TOP is constituted by a time period formed by subtracting the valve opening time PINJOP from T180.

Figure 15:
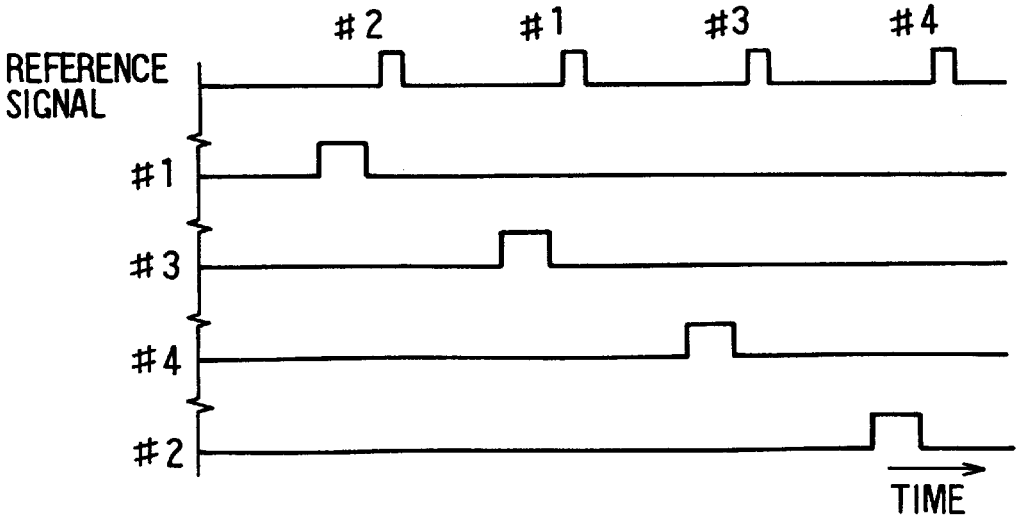
FIG. 15 is a time chart showing a control of driving the injector in respect of reference signals of respective cylinders according to the first embodiment.

Next, the operation proceeds to step S425, and to which cylinder the basic timing of the injector 17 belongs is determined. The subroutine is finished when the criteria of step S425 is not established. Meanwhile, when the basic timing belongs to a certain cylinder, the criteria of step S425 is established, as shown by the reference signals of the respective cylinders and a drive sequence of the injector 17 corresponding thereto in FIG. 15, the injector 17 in correspondence with the cylinder is selected, thereafter, the operation proceeds to step S426 and the valve opening timing TOP is calculated by subtracting the valve opening time PINJOP from the reference signal T180. Next, at step S427, a valve opening timer for driving to open the injector 17 is set and at step S428, a valve closing timer for driving to close the injector 17 is set respectively. In this way, by interruption of time a fuel amount in correspondence with the fuel injection time TAU is injected from the injector 17 into the intake path 2 of the internal combustion engine 1 from the valve opening timing TOP.

Figure 16:
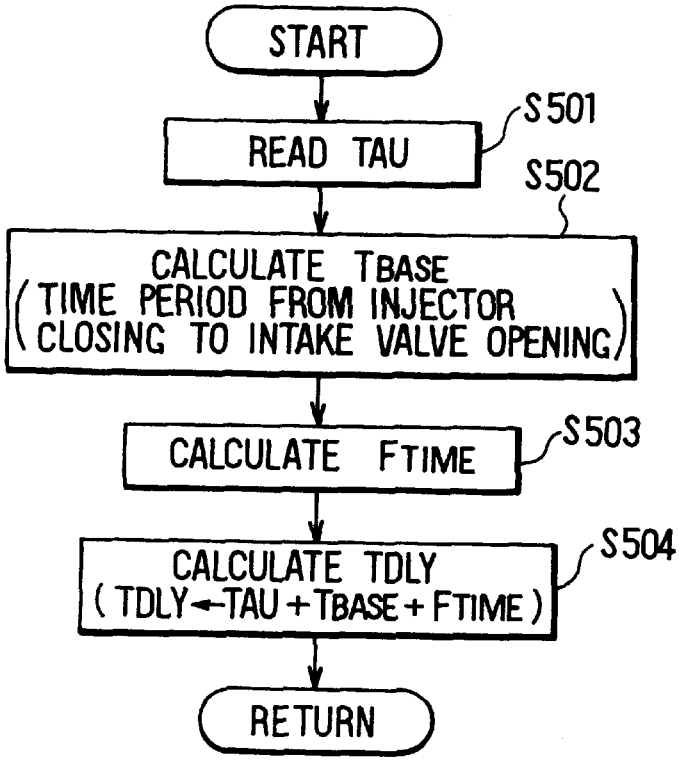
FIG. 16 is a flow chart showing an intake pressure timing calculating process in FIG. 3.
Figure 17:
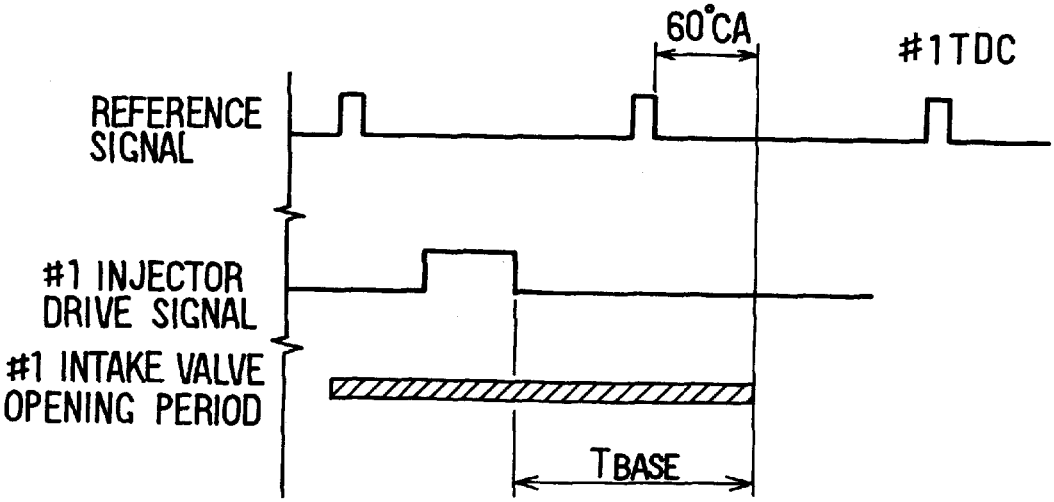
FIG. 17 is a time chart showing a time period required from opening the injector and closing an injector valve in FIG. 16.

Next, the intake pressure timing calculating processing (estimated load correction processing) of step S500 in FIG. 3 is executed. In FIG. 16, the fuel injection time TAU is read at step S501. Next, the operation proceeds to step S502 and a time period TBASE required from closing the injector 17 to opening the intake valve 18. In this case, the fuel injection timing of the subroutine is controlled by the valve closing timing of the injector 17 (valve closing time PINJCL of the injector 17 calculated by the data map of FIG. 13 at step S423 of FIG. 12) and the required time TBASE is calculated by a phase difference between the target valve closing time of the injector 17 and the valve closing time of the intake valve 18 determined by the cam profile of the internal combustion engine 1 (FIG. 17). Next, the operation proceeds to step S503 and other required time FTIME (valve closing delay time or the like) is calculated and thereafter, the operation proceeds to step S504 and a delay time TDLY from a time point of calculating fuel injection to a time point of closing the intake valve 18 that is a time point of determining an amount of charging mixture gas into the cylinder is calculated by adding the fuel injection time TAU, the required time TBASE and the required time FTIME. In this case, the value of the target intake pressure PM calculated by correcting the intake pressure PM used in the fuel system calculation by the delay time TDLY is the intake pressure PM adapted to the fuel injection.

Figure 18:
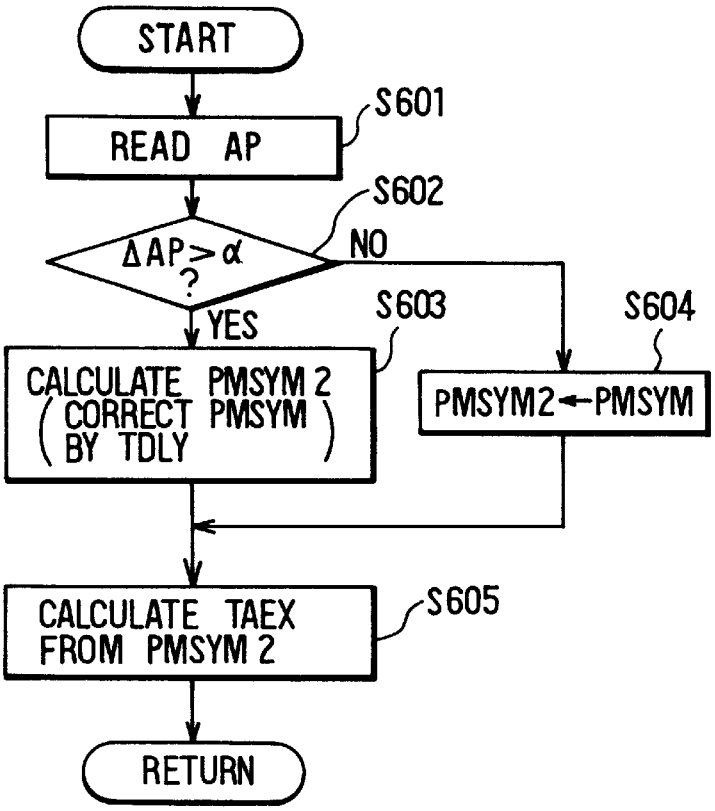
FIG. 18 is a flow chart showing a target throttle opening angle calculating process in FIG. 3.
Figure 19A:
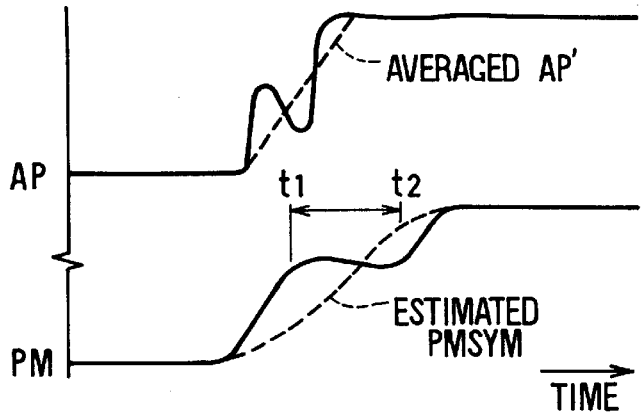
FIGS. 19A to 19C are time charts showing throttle control operations in the first embodiment in comparison with the prior art.
Figure 19B:
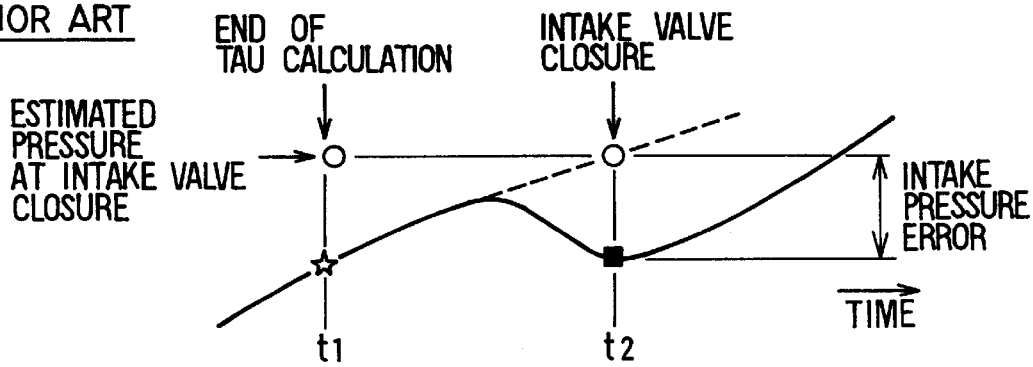
FIG. 19B PRIOR ART
Figure 19C:
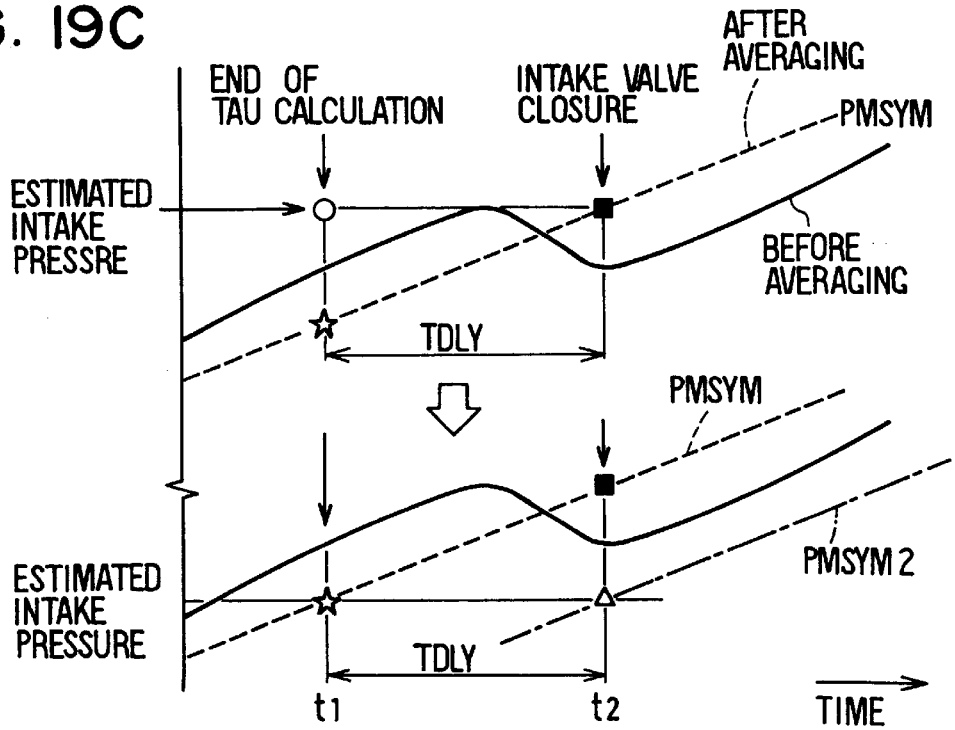

The step S600 of FIG. 3 in which the throttle valve target opening angle is calculated is shown in FIGS. 18, 19A and 19C. Specifically, FIG. 19A shows a control process for the averaged accelerator depression position AP' in respect of the accelerator depression position AP and the estimated intake pressure PMSYM in respect of the intake pressure PM when the throttle control is carried out. FIG. 19B and FIG. 19C show details of an interval between a time point t1 through a time point t2 in FIG. 19A. FIG. 19B shows a situation of occurrence of a conventional error in reading the intake pressure and FIG. 19C shows a situation of adapting estimated intake pressure before averaging and after averaging the accelerator depression position. Further, a time point t1 designates a time point of finishing the calculation of the fuel injection time TAU and the time point t2 designates a time point of closing the Intake valve 18.

In FIG. 18, at step S601, the accelerator depression position AP is read. Next, the operation proceeds to step S602 and whether the accelerator depression position change amount ΔAP exceeds the predetermined value a is determined. When the the accelerator depression position change amount ΔAP exceeds the predetermined value α, the operation proceeds to step S603 and an estimated intake pressure PMSYM2 which is formed by correcting the estimated intake pressure PMSYM calculated at step S300 in the base routine of FIG. 3 by the delay time TDLY, is calculated (FIG. 19C). Meanwhile, when the accelerator depression position change amount ΔAP is equal to or lower than the predetermined value α, the operation proceeds to step S604 and the estimated intake pressure PMSYM calculated at step S300 in the base routine of FIG. 3 is used as the estimated intake pressure PMSYM2 as it is and the correction of intake pressure timing is not carried out.

After the processing at step S603 or step S604, the operation proceeds to step S605 and the throttle valve target opening angle TAEX is calculated such that the estimated intake pressure PMSYM2 is constituted by using the equation of state of gas for calculating the estimated intake pressure PMSYM and calculating by a reverse procedure, that is, by the procedure of calculating the estimated intake pressure PMSYM2→the air amount Gin passing through the surge tank→the air amount Ginα passing through the throttle valve→the flow sectional area S→the throttle valve target opening angle TAEX. Further, the DC motor 4 of the throttle valve 3 is driven by performing the feedback control based on the throttle opening angle signal TA from the throttle opening angle sensor 5 such that the throttle valve openibng angle TA is controlled to its target opening angle TAEX.

In this way, according to the throttle control device for the internal combustion engine of the embodiment, when the accelerator depression position is changed as in the accelerator depression position AP in FIG. 19A, the averaged accelerator depression position AP' is calculated by the processing of averaging the accelerator depression position at step S200 of FIG. 3. Further, the intake pressure when the throttle opening angle is controlled based on the averaged accelerator depression position AP', is estimated by the intake pressure estimating processing at step S300 of FIG. 3. Further, the target throttle opening angle TAEX is calculated to provide or attain the estimated intake pressure PMSYM and the throttle opening angle is controlled by the throttle valve target opening angle calculating processing at step S600 of FIG. 3. Accordingly, in the fuel system calculating processing at step S400 of FIG. 3 as shown by FIG. 19C, the fuel injection amount TAU is calculated based on the estimated intake pressure PMSYM. Therefore, even in the complicated accelerator operation as shown by FIGS. 19A, 19B and 19C, the fuel injection control can be carried out with the least error of reading the intake pressure, as shown by FIG. 19(*b*), that is, without disturbance of A/F (air-fuel ratio). Further, the target opening angle calculating processing of the throttle valve 3 is preferably carried out after the fuel system calculating processing. That is, by performing previously the fuel system calculating processing, the intake pressure timing calculating processing executed at step S500 of FIG. 3 is carried out, and the estimated intake pressure PMSYM is corrected in consideration of the delay time TDLY in supplying the fuel amount calculated in the fuel system calculating processing from the injector 17 to the internal combustion engine 1 and in the throttle valve target opening angle calculating processing at step S600, the target throttle opening angle TAEX of the throttle valve 3 can be calculated based on the corrected intake pressure PMSYM2. Thereby, A/F (air-fuel ratio) can be controlled further accurately. Further, although according to the embodiment, only the throttle valve opening angle is controlled, in a system having an ISC (Idle Speed Control) valve, the control may be performed by also using the ISC valve to provide the estimated intake pressure.

In the meantime, although according to the embodiment, the DC motor 4 is used as an actuator for opening and closing the throttle valve 3, a stepping motor or the like may be used instead.

Further, although according to the embodiment, the intake pressure is estimated from the accelerator depression position, in a system having an air flow meter and calculating the fuel injection amount based on an intake air amount and the engine rotational speed, the intake air amount may be estimated from the accelerator depression position. Also in this case, similar to the embodiment, the fuel amount may be calculated based on the estimated intake air amount and the target throttle opening angle may be calculated based on the estimated intake air amount corrected in consideration of delay in supplying fuel or the like.

(Second Embodiment)

Figure 21:
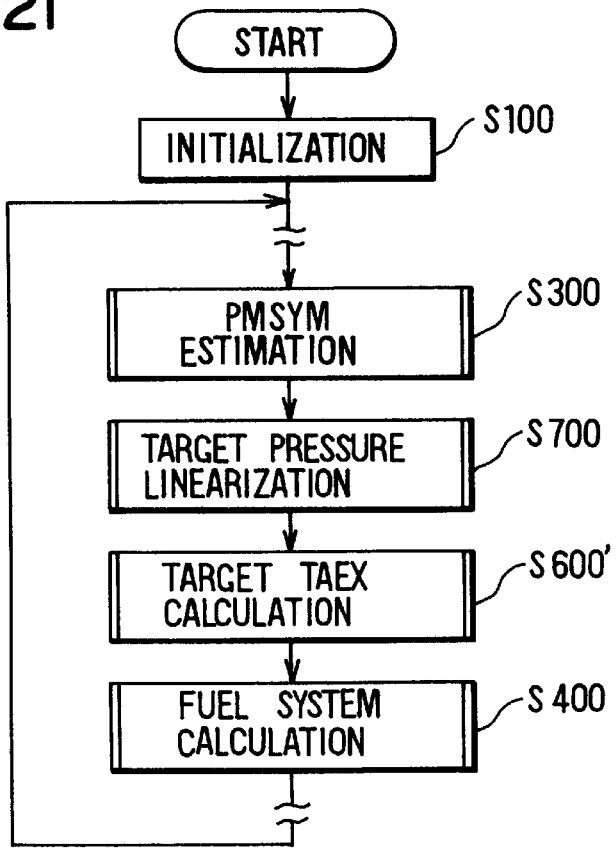
FIG. 21 is a flow chart showing a throttle control base routine of a CPU used in a second embodiment of the present invention.

In FIG. 21 showing the second embodiment, firstly, at step S100, initializing operation is executed simultaneously with the start of electric power supply (starting power supply) by turning on the ignition switch (not illustrated). In this initializing operation, for example, variable storing regions of RAM 23 and the like are set to initial values and input signals from various sensors are checked.

After the initializing operation at step S100, at step S300, the intake pressure PMSYM is estimated before operating the throttle valve 3 with the accelerator depression position AP, the engine rotational speed NE and the like as parameters. Next, the operation proceeds to step S700 and a target intake pressure linearly rising is calculated based on the estimated intake pressure PMSYM by an intake pressure linearizing processing (estimated load correction). Next, the operation proceeds to step S600' and the optimum throttle valve target opening angle TAEX of the throttle valve 3 based on the target intake pressure is calculated by a throttle valve target opening angle calculating processing (throttle opening angle control) in order to realize the linearized intake pressure. Next, the operation proceeds to step S400 and the fuel amount in compliance with the linearized intake pressure is calculated by the fuel system calculating processing (fuel amount calculation) and thereafter, steps S300, S700, S600' and S400 are executed repeatedly.

Figure 22:
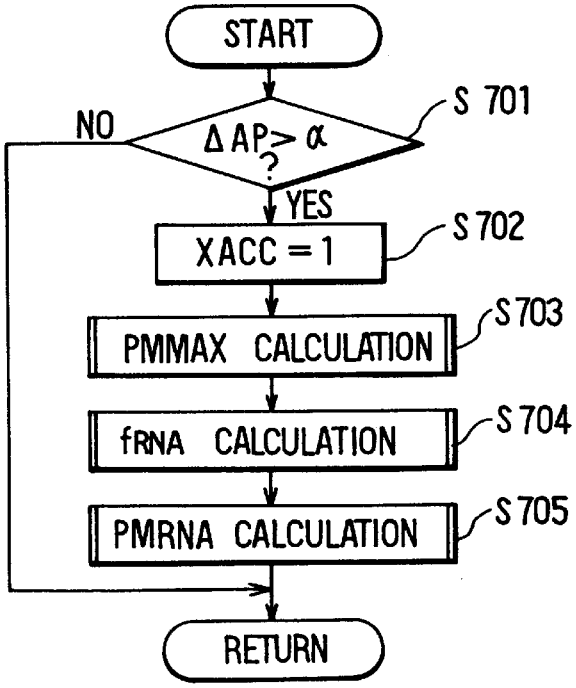
FIG. 22 is a flow chart showing an intake pressure linearizing process in FIG. 21.

Next, the subroutine of the intake pressure linearizing processing at step S700 of FIG. 21 is shwon in FIGS. 22 to 25. In FIG. 22, at step S701, whether the accelerator depression position change amount ΔAP exceeds the predetermined value α is determined. In this case, the predetermined value α is a reference to determine whether the rise behavior of the intake pressure PM needs the linearization of the intake pressure PM. When the criteria of step S701 is not established, the subroutine is finished. Meanwhile, when the criteria of step S701 is established, the operation proceeds to step S702 and an intake pressure linearizing processing allowance flag XACC is set (XACC=1). Next, the operation proceeds to step S703 and a saturated intake pressure PMMAX to which the intake pressure PM is estimated to converge when the throttle opening angle TA in correspondence with the accelerator depression position AP is attained, is calculated by the saturated intake pressure PMMAX calculating processing.

Figure 23:
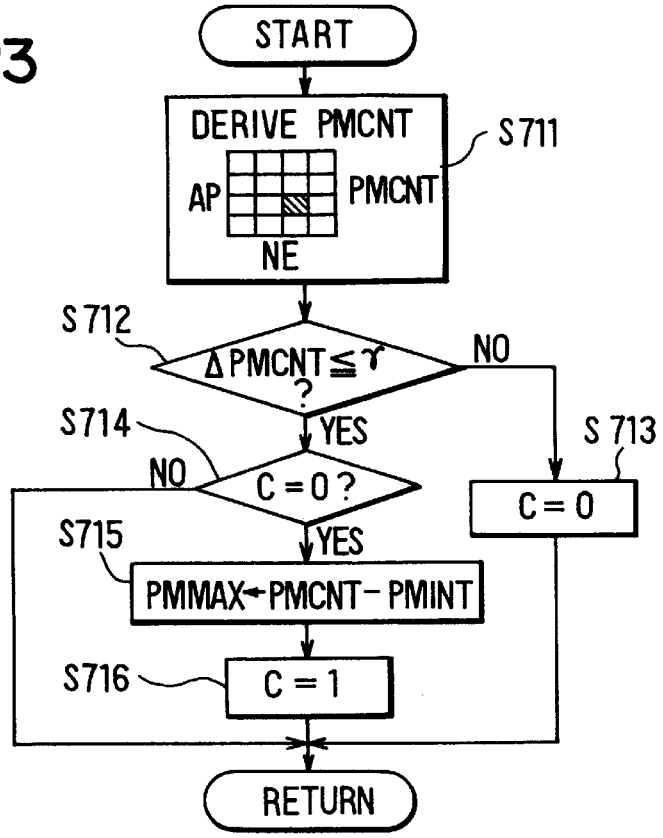
FIG. 23 is a flow chart showing a saturated intake pressure calculating process in FIG. 22.

In this saturated intake pressure PMMAX calculating subroutine shown in FIG. 23 in detail, at step S711, an intake pressure PMCNT stabilized in a steady state is calculated by deriving from the data map in relation to the accelerator depression position AP and the engine rotational speed NE as parameters. Next, the operation proceeds to step S712 and a change amount ΔPMCNT of the intake pressure PMCNT produced by differentiating the intake pressure PMCNT is equal to or lower than γ and the accelerator depression position AP is in a stabilized state, is determined. When the criteria of step S712 is not established and the acceleration instruction is being issued, the operation proceeds to step S713 and an accelerator instruction state flag C is set to "0" by which the subroutine is finished.

Meanwhile, when the criteria of step S712 is established and the accelerator depression position AP is determined to be in a stabilized state (also intake pressure PMCNT is in a stabilized state), the operation proceeds to step S714 and whether the state of the accelerator instruction state flag C at a preceding time is changed for the first time to the stabilized state (C=0) at a current time, is determined. When the criteria of step S714 is not established, the subroutine is finished. Meanwhile, when the criteria of step S714 is established, the accelerator instruction state flag is C=0 and the acceleration instruction is changed for the first time to the stabilization instruction at the current time, the operation proceeds to step S715 and the saturated intake pressure PMMAX is calculated by subtracting the intake pressure PMINT before the acceleration instruction from the intake pressure PMCNT. Next, the operation proceeds to step S716, the stabilized state where the accelerator instruction state flag C is set (C=1).

Figure 24:
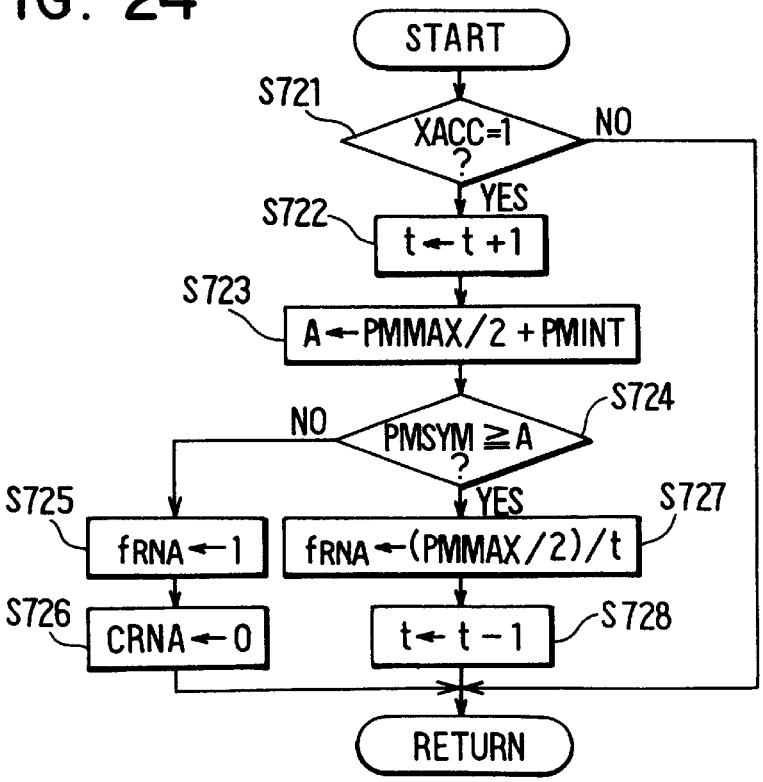
FIG. 24 is a flow chart showing coefficient linearizing process in FIG. 22.
Figure 27:
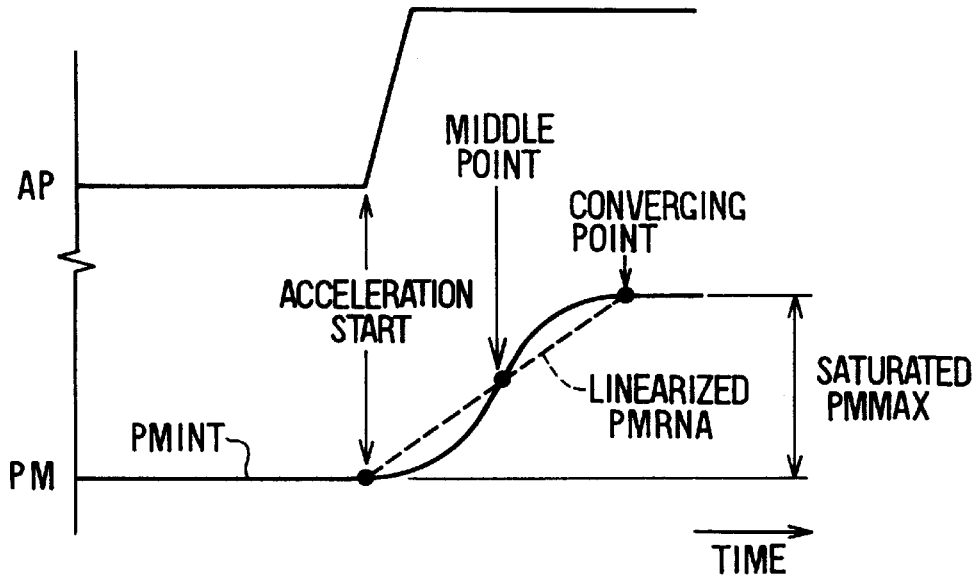
FIG. 27 is a characteristic graph showing a relationship between an accelerator depression amount and an intake pressure in the second embodiment.
Figure 28:
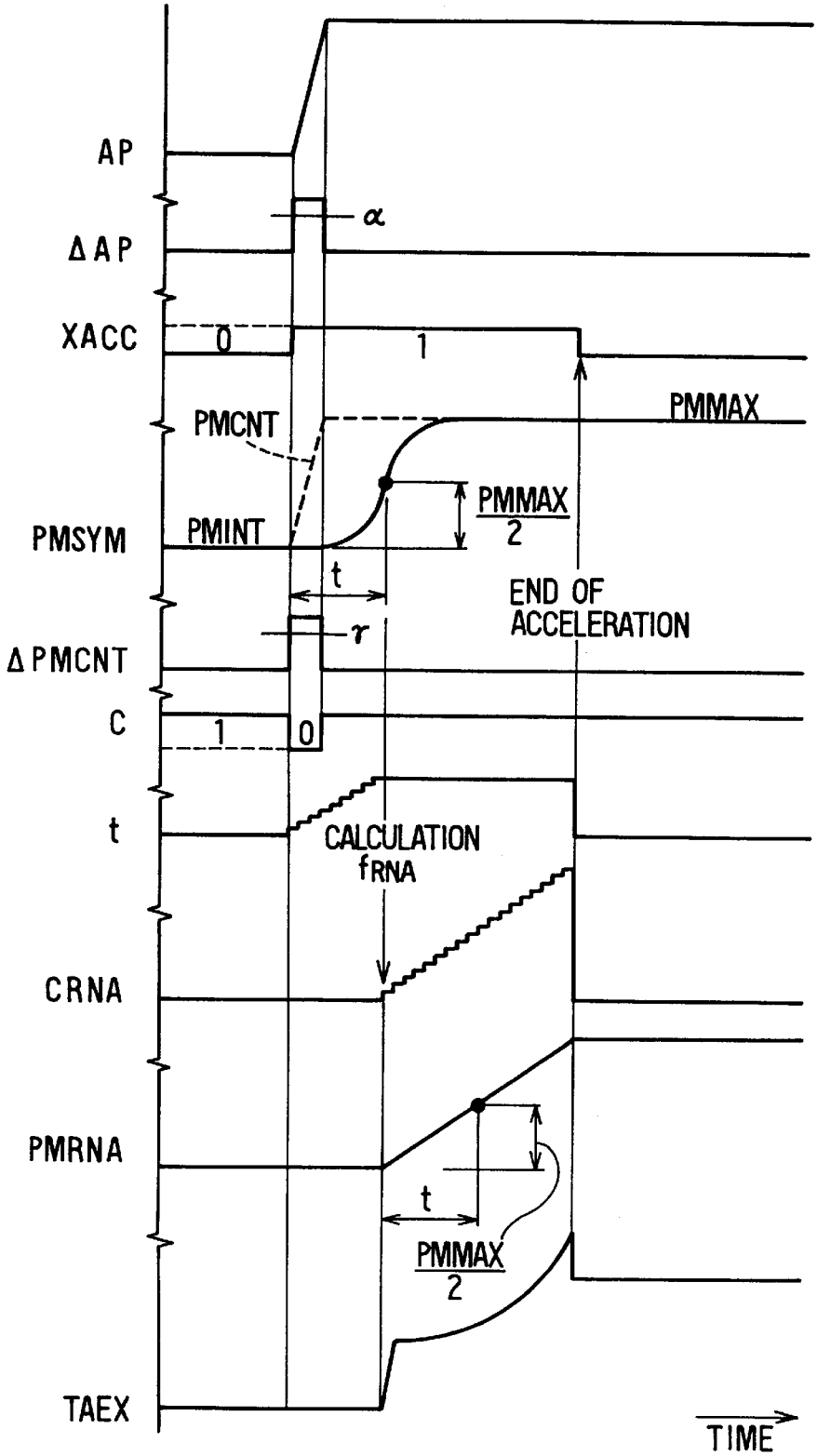
FIG. 28 is a time chart showing a transient control operation in the second embodiment.

After the saturated intake pressure calculation at step S703 in FIG. 22, at step S704, a linearizing coefficient calculating processing shown in FIG. 24 in detail is performed as shown in FIGS. 27 and 28. At step S721, whether the intake pressure linearizing processing allowance flag XACC is set (XACC=1) is determined. When the criteria of step S721 is not established, the subroutine is finished. Meanwhile, when the criteria of step S721 is established, it is determined that the linearizing processing of intake pressure is allowed, the operation proceeds to step S722 and a post-acceleration counter counting a time period elapsed from an acceleration point is incremented by "+1". Next, the operation proceeds to step S723 and an intake pressure value calculated by adding an intake pressure PMINT (intake pressure PMINT in this case is an offset value) which corresponds to the intake pressure) before acceleration instruction to the middle point of the saturated intake pressure PMMAX to which the intake pressure PM is estimated to converge after acceleration, is stored to a register A. In this case, in respect of the middle point of the saturated intake pressure PMMAX, when the throttle valve 3 is actually changed linearly, the rising curve of the intake pressure PM is changed approximately to a regular sine curve and therefore, the middle point of the rising curve of the intake pressure PM is an only point which coincides with the linearized intake pressure PM and the rising speed of the linearized intake pressure PMRNA can be calculated by connecting that point and the acceleration point (FIG. 27).

Next, the operation proceeds to step S724 and whether the estimated intake pressure PMSYM is equal to or larger than the intake pressure stored to the register A is determined. When the criteria of step S724 is not established and the estimated intake pressure PMSYM does not reach the middle point, the operation proceeds to step S725, a linearizing coefficient fRNA for linearizing the rise of the intake pressure is set to "1", the operation proceeds to step S726 and a linearizing timer CRNA of the intake pressure PM is reset to "0" as initialization.

Meanwhile, when the criteria of step S724 is established and the estimated intake pressure PMSYM reaches the middle point, the operation proceeds to step S727 and the linearizing coefficient fRNA is calculated by dividing the deviation PMMAX/2 of the intake pressure PM at the middle point by the post acceleration counter t. Next, the operation proceeds to step S728 and the post-acceleration counter t is decremented by "−1" (t value is held after PMSYM≧A).

Figure 25:
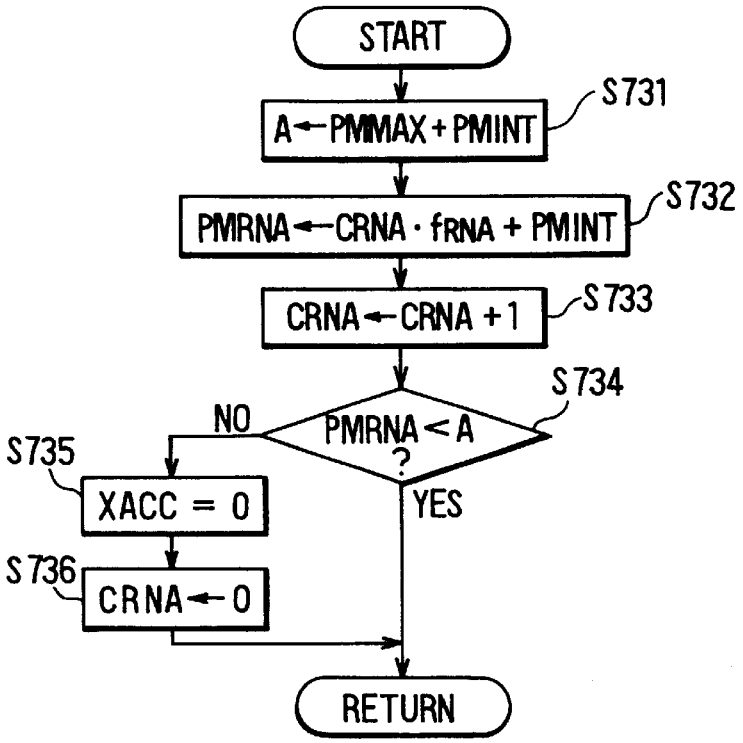
FIG. 25 is a flow chart showing a linearized intake pressure calculating process in FIG. 22.

Next, referring back to FIG. 22, at step S705, the processing of calculating a linearized intake pressure PMRNA is carried out by the routine shown in FIG. 25. At step S731, the pre-acceleration intake pressure PMINT is added to the saturated intake pressure PMMAX and the estimated intake pressure PMSYM (FIG. 27) that is estimated to converge after acceleration is stored in the register A. Next, the operation proceeds to step S732, the linearizing coefficient fRNA is multiplied by a linearizing timer CRNA, the pre-acceleration intake pressure PMINT is added to the result of multiplication and the intake pressure is offset by which a linearized intake pressure PMRNA is calculated. Next, the operation proceeds to step S733 and the linearizing timer CRNA is incremented by "+1". The linearizing timer CRNA is counted up when the linearizing coefficient fRNA is calculated (middle point of the estimated intake pressure PMSYM) as shown in FIG. 28.

Next, the operation proceeds to step S734 and whether the linearized intake pressure PMRNA is less than the estimated intake pressure PMSYM which has been calculated at step S731 and stored in the register A and which is estimated to converge after acceleration, is determined. When the criteria of step S734 is established and the linearized intake pressure PMRNA does not reach the estimated intake pressure PMSYM, the subroutine is finished with the value as it is. Meanwhile, when the criteria of step S734 is not established and the linearized intake pressure PMRNA reaches the estimated intake pressure PMSYM, the operation proceeds to step S735, the intake pressure linearizing processing allowance flag XACC is cleared to "0" and thereafter, the linearizing timer CRNA is reset to "0" at step S736. Thereafter, the operation returns to FIG. 22 and the subroutine is finished.

Figure 26:
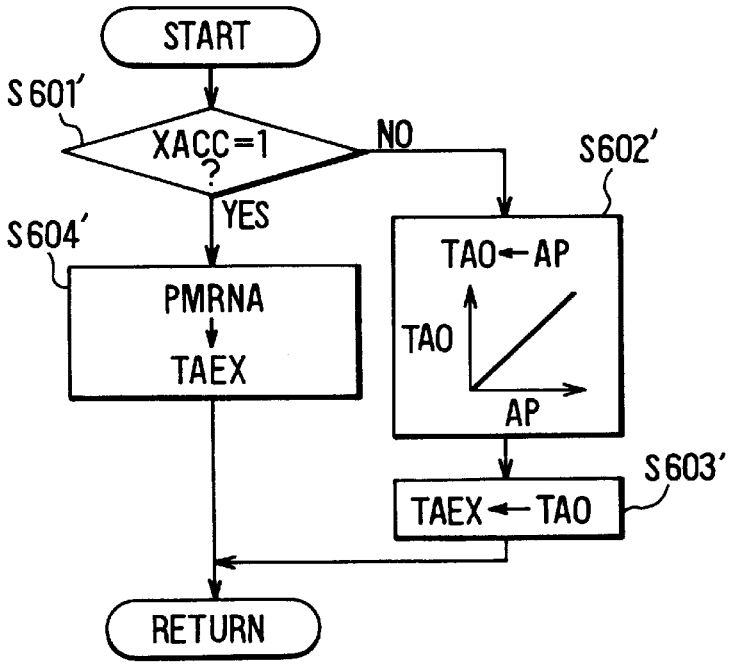
FIG. 26 is a flow chart showing a target throttle opening amount calculating process in FIG. 21.

Next, the operation returns to FIG. 21, at step S600', the processing of calculating the target opening angle TAEX of the throttle valve 3 is executed as shown by the subroutine shown in FIG. 26 in detail. At step S601', it is determined whether the intake pressure linearizing processing allowance flag XACC is set to "1". When the criteria of step S601' is not established and the intake pressure linearizing processing is not allowed, the operation proceeds to step S602' and the throttle opening angle TAO is calculated based on the normal accelerator depression position AP and by using a conversion table. Next, the operation proceeds to step S603' and the throttle opening angle TAO is stored to the throttle valve target opening angle TAEX.

Meanwhile, when the criteria of step S601' is established and the intake pressure linearizing processing is allowed, the operation proceeds to step S604' and the throttle valve target opening angle TAEX is calculated such that the linearized intake pressure PMRNA is constituted by the reverse procedure by reading the linearized intake pressure PMRNA which has been processed at step S700 of the above base routine and by using the equation of state of gas calculating the estimated intake pressure PMSYM, that is, by the procedure of the linearized intake pressure PMRNA→the air amount Gin passing through a surge tank→the air amount Ginα passing through the throttle valve→the flow sectional area S→the throttle valve target opening angle TAEX. Further, the DC motor 4 of the throttle valve 3 is driven by performing a feedback control based on the throttle opening angle signal TA from the throttle opening angle sensor 5 such that the throttle valve target opening angle TAEX is attained by the output circuit 26.

Figure 29:
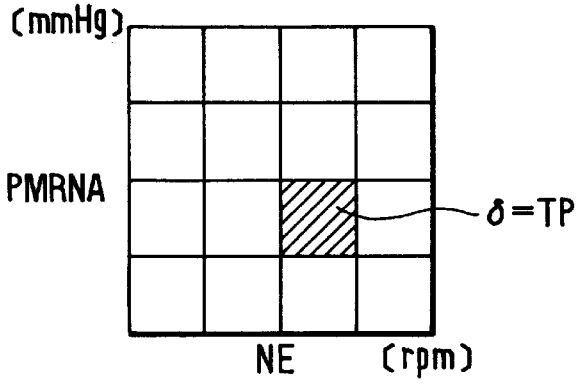
FIG. 29 is a data map showing a basic fuel injection time.

Next, referring back to FIG. 21, at step S400, the fuel system calculating processing is carried out. In this processing, the basic fuel injection time TP which is calculated to establish λ=1 previously by experiment with the engine rotational speed NE and the linearized intake pressure PMRNA as parameters by a data map shown in FIG. 29, is used.

Figure 30:
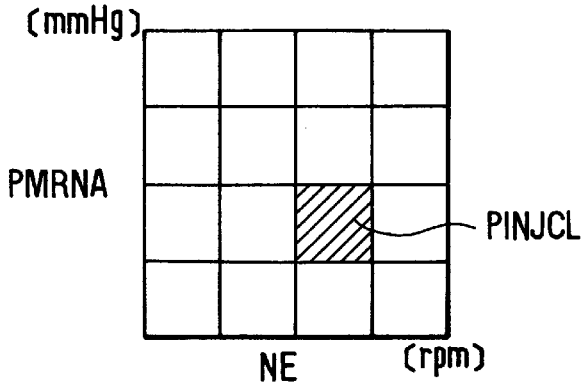
FIG. 30 is a data map showing a valve closing time of an injector.

Next, in controlling to drive of the injector 17, the valve closing time PINJCL of the injector 17 is calculated based on a data map shown in FIG. 30.

Figure 31:
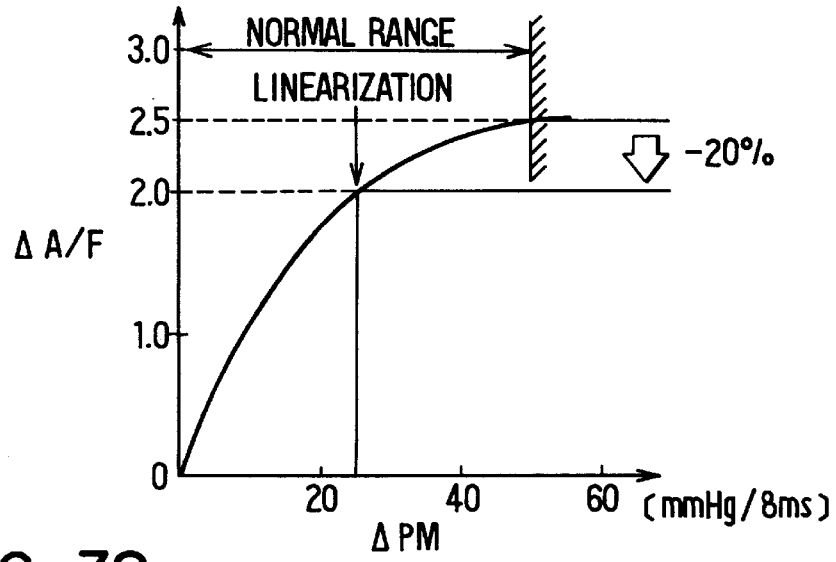
FIG. 31 is a characteristic graph showing a deviation of an air-fuel ratio in respect of a change in an intake air amount in the second embodiment.

According to the embodiment, as shown by FIG. 31, the change amount ΔPM of the intake pressure from the start of acceleration to the end of acceleration is distributed in a range of 0 through 50 [mmHg/8 ms] as the normal range of use. Therefore, in respect of occurrence of the maximum deviation ΔA/F of A/F of about 2.5, the change amount ΔPM of the intake pressure is restrained to about 25 [(mmHg/8 ms] by the linearizing correction of the intake pressure PM, a maximum deviation ΔA/F of A/F is restrained to about 2.0 and the rate of reduction of 20% is reflected to emission.

As described above, the rise of the intake pressure PM is linearized, the estimation of the intake pressure PM of the mixture charged into the cylinder of the internal combustion engine 1 is facilitated, the calculation of the fuel injection time TAU is facilitated and therefore, deviation of A/F can be reduced. Further, the maximum change amount ΔPM of the intake pressure is reduced and variation of A/F can be restrained since the change amount ΔPM of the intake pressure is averaged.

By such a control, the deviation ΔPM of the intake pressure between the intake pressure PM in the fuel system calculation and the intake pressure PM of the mixture charged into the cylinder can be resolved as the target intake pressure PM and ΔA/F that is a deviation of A/F from λ=1 can be restrained by eliminating measurement error caused by the intake pressure deviation ΔPM and accordingly, emission can be reduced.

Figure 32:
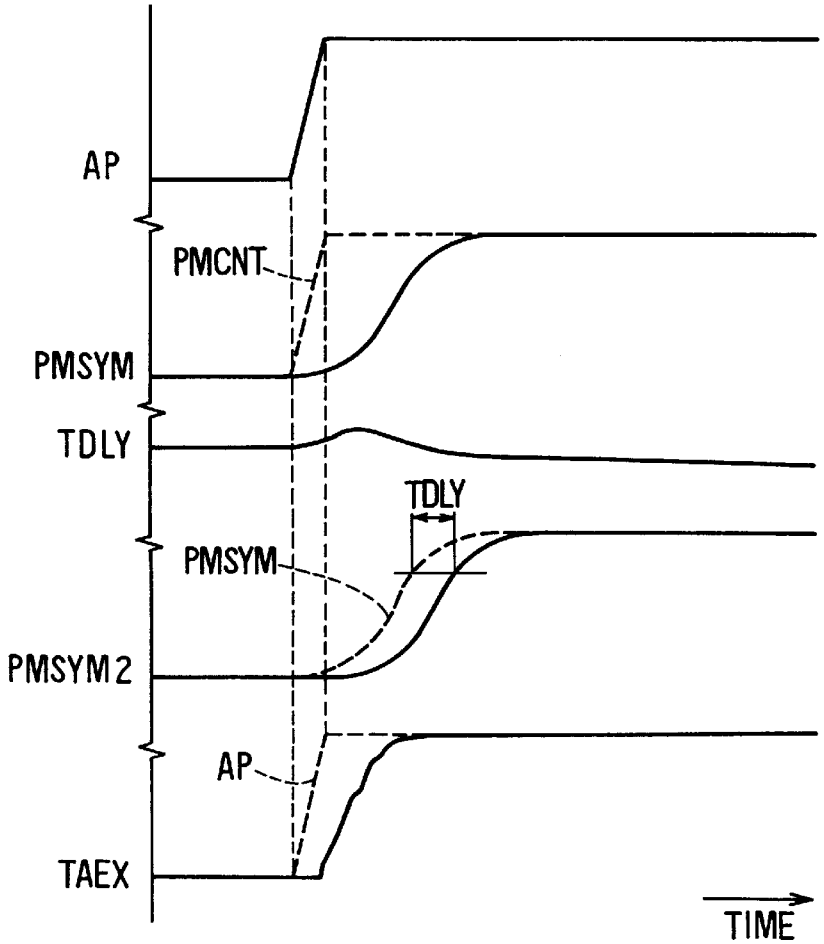
FIG. 32 is a time chart showing a throttle control operation in the modification of the second embodiment.

Next, the second embodiment may be modified to operate as shown in FIG. 32. That is, similarly to the second embodiment, the estimated intake pressure PMSYM estimating the intake pressure PM is calculated. Next, an intake pressure delay correction time TDLY is calculated by the following equation (4).

$$TDLY\ [\text{ms}] = TAU + (\text{time required from closing injector to opening intake valve}) + (\text{ineffective injection time}) + (\text{valve closing delay time}) + (\text{fuel spray flying time}) \quad (4)$$

Next, the delay intake pressure PMSYM2 which is formed by delaying the estimated intake pressure PMSYM by the intake pressure delay correction time TDLY, is calculated. Further, similarly to the swcond embodiment, the throttle valve target opening angle TAEX is calculated and the output processing in respect of the DC motor 4 for driving the throttle valve 3 is executed. According to the fuel system calculation in the second embodiment, the basic fuel injection time is calculated based on the linearized intake pressure value PM, however, in this modification, the calculation is executed based on the estimated intake pressure PMSYM before correction (FIG. 32). Accordingly, in this modification, the fuel system calculating processing at step S400 is carried out prior to the throttle valve target opening angle calculating processing at step S600' of FIG. 21. Further, after executing the fuel system calculating processing, the intake pressure delay processing corresponding to the intake pressure linearizing processing at step S700 is carried out. Thereafter, similar processings are performed as in the second embodiment.

In this way, according to this modification, a correction where the intake pressure estimated by the intake pressure estimating processing is delayed by the intake pressure delay correction time TDLY is carried out in place of the intake pressure linearizing processing executed at step S700 of FIG. 21. In this case, the intake pressure delay correction time is a delay time of a fuel system in respect of an change in the intake pressure. In the fuel system calculating processing, the fuel injection amount is calculated based on the intake pressure estimated by the intake pressure estimating processing. Further, according to the throttle valve target opening angle calculating processing, the throttle valve target opening angle TAEX is calculated based on the estimated intake pressure PMSYM which has been subjected to delay correction. Therefore, fuel is actually injected after being delayed to the change in the intake pressure by a predetermined time period, however, the delay of the predetermined time period corresponding to the delay in the fuel injection is provided to the throttle valve target opening angle and therefore, deviation of air-fuel ratio can be improved.

Although the intake pressure is estimated and corrected as the load in the second embodiment and its modification, the intake air amount may be estimated and the throttle valve opening angle may be calculated based on a corrected estimated intake air amount resulting from a correction of the estimated intake air amount.

What is claimed is:

1. A throttle control device for an internal combustion engine, said device comprising:

smoothing means for smoothing sensed accelerator depression changes;

load estimating means for estimating future engine load based on the smoothed accelerator depression change;

fuel amount calculating means for calculating an estimated future engine fuel supply amount based on the estimated future engine load; and throttle opening angle controlling means for calculating a corresponding target throttle opening angle to provide the future estimated load at a future fuel injection time.

2. A throttle control device for an internal combustion engine as in claim 1, wherein:

the smoothing means effects a degree of smoothing corresponding to a warm-up state of the internal combustion engine.

3. A throttle control device for an internal combustion engine as in claim 1, wherein:

the smoothing means smoothes the sensed accelerator depression change for at least one of the following: (a) where the magnitude of accelerator depression change is larger than a predetermined amount, and (b) where the magnitude of accelerator depression change is lower than the predetermined amount for more than a predetermined time period.

4. A throttle control device for an internal combustion engine as in claim 1, wherein:

the throttle opening angle controlling means further includes estimated load correcting means for calculating estimated fuel injection delay time caused by the fuel amount calculating means and for then correspondingly correcting the estimated load; and the target throttle opening angle is calculated based on the estimated load corrected by the estimated load correcting means.

5. A throttle control device for an internal combustion engine, said device comprising:

a throttle valve;

driving means for driving the throttle valve;

a fuel injector;

detecting means for detecting accelerator depression;

smoothing means for smoothing changes in detected accelerator depression position;

load estimating means for estimating a future engine load based on the smoothed accelerator depression change;

fuel amount calculating means for calculating estimated future fuel injection amounts based on the estimated load; and throttle opening angle controlling means for calculating a corresponding target throttle opening angle to provide the estimated future load at the future time of fuel injection.

6. A throttle control method of an internal combustion engine, said method comprising:

smoothing sensed changes in accelerator depression;

estimating a future engine load based on the smoothed accelerator depression changes;

calculating an estimated future fuel injection amount based on the estimated load; and deriving a target throttle opening angle to attain the estimated future load at the future time of injecting the estimated fuel injection amount;

wherein the calculating step is executed prior to the deriving step.

7. A throttle control device for an internal combustion engine, said device comprising:

load estimating means for estimating future engine load in accordance with sensed accelerator depression position;

a control load setting means for setting the estimated load;

fuel amount calculating means for calculating an injection fuel amount based on the thus set load; and throttle opening angle controlling means for calculating a target throttle opening angle to attain the thus set estimated future load.

8. A throttle control device for an internal combustion engine as in claim 7, wherein:

the control load setting means includes linearization setting means for setting the load to be controlled such that the load is changed linearly by connecting a change start point and a change finish point of the estimated load.

9. A throttle control device for an internal combustion engine, said device comprising:

a throttle valve;

a fuel injector;

accelerator depression position detecting means for detecting accelerator depression position;

load estimating means for estimating engine load in accordance with the detected accelerator depression position;

load setting means for setting future engine load to be controlled in accordance with an operating state of the internal combustion engine based on the estimated future load;

fuel amount calculating means for calculating an injection fuel amount based on the set load; and controlling means for deriving a target throttle valve opening angle to attain the estimated future load set by the load setting means at the time the calculated fuel amount is injected.

10. A throttle control device for an internal combustion engine, said device comprising:

load estimating means for estimating engine load in accordance with sensed accelerator depression position;

fuel amount calculating means for calculating an injection fuel amount based on the estimated load;

estimated load correcting means for delaying the estimated future load based on the calculated future fuel injection amount; and throttle opening angle controlling means for calculating a target throttle opening angle to attain the delayed estimate future load at the time the calculated future fuel estimate is injected.

* * * * *